US010663186B2

(12) United States Patent
Mowris et al.

(10) Patent No.: US 10,663,186 B2
(45) Date of Patent: May 26, 2020

(54) APPARATUS AND METHODS TO DETERMINE ECONOMIZER FAULTS

(71) Applicants: Robert J. Mowris, Olympic Valley, CA (US); John Walsh, Bozeman, MT (US)

(72) Inventors: Robert J. Mowris, Olympic Valley, CA (US); John Walsh, Bozeman, MT (US)

( * ) Notice: Subject to any disclaimer, the term of this patent is extended or adjusted under 35 U.S.C. 154(b) by 0 days.

(21) Appl. No.: 16/011,120

(22) Filed: Jun. 18, 2018

(65) Prior Publication Data

US 2018/0299155 A1 Oct. 18, 2018

Related U.S. Application Data

(63) Continuation-in-part of application No. 15/169,586, filed on May 31, 2016, now Pat. No. 10,001,289.

(51) Int. Cl.
*F24F 11/00* (2018.01)
*F24F 11/38* (2018.01)
(Continued)

(52) U.S. Cl.
CPC ..... *F24F 11/38* (2018.01); *F24F 11/46* (2018.01); *F24F 11/58* (2018.01); *F24F 2110/12* (2018.01); *F24F 2110/20* (2018.01)

(58) Field of Classification Search
CPC ..... F24F 11/30; F24F 11/0001; F24F 2011/0002; F24F 2011/0006; F24F 2140/40; F24F 11/38
See application file for complete search history.

(56) References Cited

U.S. PATENT DOCUMENTS 5,998,995 A 12/1999 Oslander
6,131,457 A 10/2000 Sato
(Continued)

FOREIGN PATENT DOCUMENTS

EP 1 904 794 B1 1/2011
EP 2 294 487 B1 3/2012

OTHER PUBLICATIONS

Robert Mowris, Ean Jones, Robert Eshom, Kathleen Carlson, John Hill, Peter Jacobs, John Stoops, Laboratory Test Results of Commercial Packaged HVAC Maintenance Faults, 2015, pp. 250, California Public Utilities Commission, San Francisco, CA, USA.
(Continued)

*Primary Examiner* — Eric S Ruppert
(74) *Attorney, Agent, or Firm* — Kenneth L. Green; Averill & Green

(57) ABSTRACT

An apparatus providing Fault Detection Diagnostics (FDD) for a Heating, Ventilating, Air Conditioning (HVAC) system comprising a permanent magnet attached to a movable damper and a magnetometer attached to a stationary frame to provide a magnetic field measurement of the permanent magnet. The apparatus converts the magnetic field measurement into a damper position measurement and determines a difference between the damper position measurement and a damper position actuator voltage command, and if the difference is greater than a damper actuator voltage tolerance, then the apparatus generates a FDD alarm signal. The apparatus calculates a com puted Outdoor Air Fraction (OAF) damper position based on a measured HVAC parameter, and if the difference between the computed OAF damper position and the OAF damper position command is greater than a damper position tolerance, then the apparatus generates a FDD alarm signal or an actuator voltage signal to correct the movable damper position.

18 Claims, 16 Drawing Sheets

(51) Int. Cl.

| | |
|---|---|
| ***F24F 11/58*** | (2018.01) |
| ***F24F 11/46*** | (2018.01) |
| *F24F 110/20* | (2018.01) |
| *F24F 110/12* | (2018.01) |

(56) References Cited

U.S. PATENT DOCUMENTS

| | | | | |
|---|---|---|---|---|
| 6,215,318 | B1 | 4/2001 | Schoefthaler | |
| 6,223,544 | B1 | 5/2001 | Seem | |
| 6,415,617 | B1 | 6/2002 | Seem | |
| 6,981,383 | B2 * | 1/2006 | Shah | F24F 3/0442 62/129 |
| 7,046,002 | B1 | 5/2006 | Edelstein | |
| 7,119,681 | B2 | 10/2006 | Eskildsen | |
| 7,131,998 | B2 | 11/2006 | Pasolini | |
| 7,444,251 | B2 | 10/2008 | Nikovski | |
| 7,446,494 | B2 | 11/2008 | Grabinger | |
| 7,492,233 | B2 | 2/2009 | Grabinger | |
| 7,500,368 | B2 | 3/2009 | Mowris | |
| 7,622,828 | B2 | 11/2009 | Grabinger | |
| 7,895,892 | B2 | 3/2011 | Aigner | |
| 8,066,558 | B2 | 11/2011 | Thomle et al. | |
| 8,195,335 | B2 | 6/2012 | Kreft | |
| 8,588,983 | B2 | 11/2013 | Grabinger | |
| 8,749,182 | B2 | 6/2014 | Grabinger | |
| 8,972,064 | B2 | 3/2015 | Grabinger | |
| 9,041,319 | B2 | 5/2015 | Grabinger | |
| 9,435,557 | B2 | 9/2016 | Albrecht | |
| 9,874,364 | B2 | 1/2018 | Bujak | |
| 9,981,529 | B2 | 5/2018 | Waseen | |
| 10,113,762 | B2 | 10/2018 | Grabinger | |
| 2004/0169244 | A1 * | 9/2004 | MacGugan | B81B 7/0074 257/416 |
| 2005/0253710 | A1 | 11/2005 | Eskildsen | |
| 2011/0160914 | A1 * | 6/2011 | Kennett | F24F 13/14 700/276 |
| 2014/0207288 | A1 | 7/2014 | Albrecht | |
| 2015/0309120 | A1 | 4/2015 | Bujak | |
| 2016/0116177 | A1 * | 4/2016 | Sikora | F24F 11/30 165/11.2 |

OTHER PUBLICATIONS

Carrier Corporation, HVAC Servicing Procedures, SK29-01A, 020-040, "Proper Airflow Method" (pp. 149-150 or pp. 7-8 of PDF), Date: 1995, pp. 196, Carrier Corporation, Farmington, CT, USA.

California Energy Commission (CEC), Residential Appendices for the Building Energy Efficiency Standards for Residential and Nonresidential Buildings, CEC-400-2008-004-CMF, Date: Dec. 1, 2008. pp. 363 (pp. RA3-9 through RA3-24), CEC, Sacramento, CA USA.

California Energy Commission (CEC), 2013 Reference Appendices The Building Energy Efficiency Standards for Residential and Nonresidential Buildings, CEC-400-2012-005-CMF-REV3, Date: Dec. 1, 2012, pp. 561 (pp. RA3-27 to RA3-28), California Energy Commission, Sacramento, CA USA.

California Energy Commission (CEC), 2016 Reference Appendices for the 2016 Building Energy Efficiency Standards Title 24, Part 6, and Associated Administrative Regulations in Part 1, CEC-400-2015-038-CMF, Date: Jun. 1, 2015, Section JA6.3 Economizer Fault Detection and Diagnostics (pp. JA6-7 through JA6-12), pp. 503, California Energy Commission, Sacramento, CA USA.

David Yuill, James E. Braun, Evaluating Fault Detection and Diagnostics Protocols Applied to Air-Cooled Vapor Compression Air-Conditioners, International Refrigeration and Air Conditioning Conference, Paper 1307, pp. 11, http://docs.lib.purdue.edu/iracc/1307, Purdue University School of Mechanical Engineering, West Lafayette, IN USA.

Stewart M. Kohler, MEMS Inertial Sensors with Integral Rotation Means, pp. 21, SAND2003-3388, Date: Sep. 2003, Sandia National Laboratories, Albuquerque, New Mexico and Livermore, California USA.

American Society Heating Refrigeration Air-Conditioning Engineers (ASHRAE), ANSI/ASHRAE Standard 62.1-2013, Ventilation for Acceptable Indoor Air Quality, pp. 58, Date: Jan. 25, 2012, ASHRAE, Atlanta, GA USA.

David Warden, Supply Air CO2 Control of Minimum Outdoor Air for Multiple Space Systems, pp. 10, Date: Oct. 2004, ASHRAE, Atlanta, GA USA.

Honeywell,. JADE Economizer Module (Model W7220); 2014, 32 pages; copyright 2014, HONEYWELL, Golden Valley, MN 55422, USA.

Belimo, Belimo ZIP Economizer™ Installation and Operation Manual, May 3, 2013, 36 pages, BELIMO, Danbury, CT 06810, USA.

P. Jacobs, Architectural Energy Corporation, Small HVAC Problems and Potential Savings Reports, Oct. 2013, 316 pages, 500-03-082-A-25, California Energy Commission, Sacramento, CA USA.

* cited by examiner

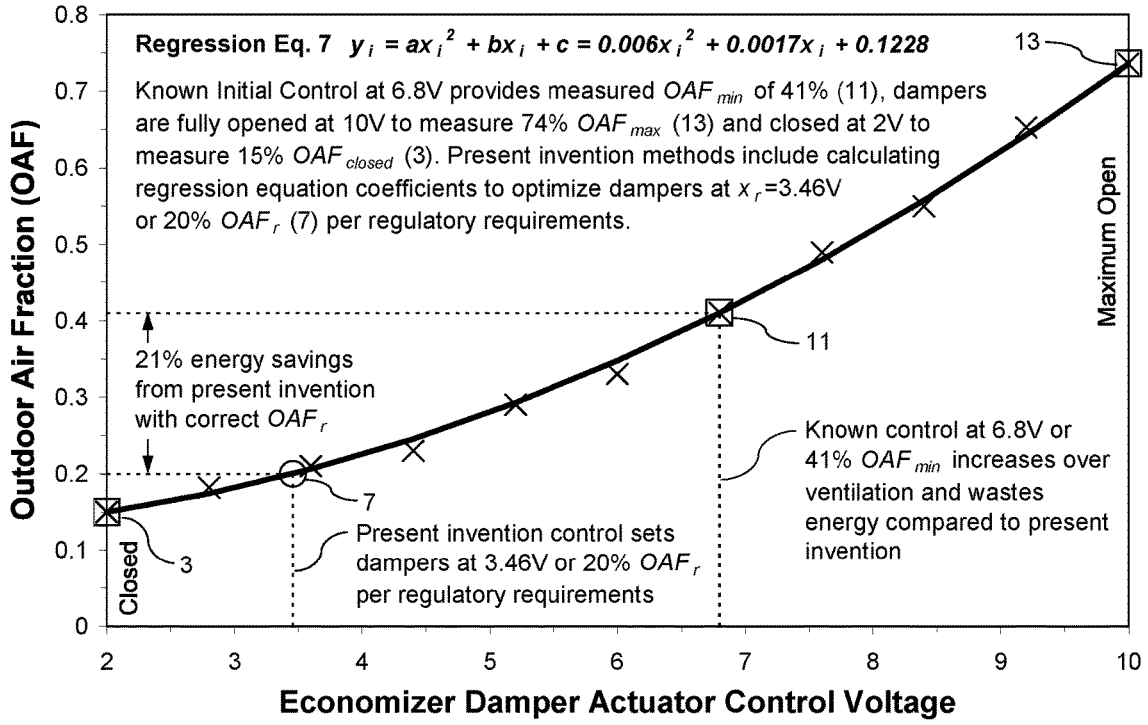

*FIG. 9*

| Damper Position | $x_i$ (Volts) | $y_i$ (OAF) |
|---|---|---|
| Initial $OAF_{min}$ | 6.8 | 0.41 |
| Maximum $OAF_{max}$ | 10.0 | 0.74 |
| Optimal $OAF_r$ | 3.46 | 0.20 |
| Closed $OAF_{closed}$ | 2.0 | 0.15 |

Eq. 7 $$y_i = ax_i^2 + bx_i + c = 0.006x_i^2 + 0.0017x_i + 0.1228$$

Eq. 9 $$\underbrace{\begin{bmatrix} \sum x_i^4 & \sum x_i^3 & \sum x_i^2 \\ \sum x_i^3 & \sum x_i^2 & \sum x_i \\ \sum x_i^2 & \sum x_i & n \end{bmatrix}}_{X} \underbrace{\begin{bmatrix} a \\ b \\ c \end{bmatrix}}_{C} = \underbrace{\begin{bmatrix} \sum x_i^2 y_i \\ \sum x_i y_i \\ \sum y_i \end{bmatrix}}_{Y} = \underbrace{\begin{bmatrix} 12154.14 & 1322.43 & 150.24 \\ 1322.43 & 150.24 & 18.8 \\ 150.24 & 18.8 & 3 \end{bmatrix}}_{X} \underbrace{\begin{bmatrix} a \\ b \\ c \end{bmatrix}}_{C} = \underbrace{\begin{bmatrix} 93.16 \\ 10.45 \\ 1.295 \end{bmatrix}}_{Y}$$

Eq. 11 $$C = \begin{bmatrix} a \\ b \\ c \end{bmatrix} = X^{-1}Y = \begin{bmatrix} 0.0064 & -0.0757 & 0.1516 \\ -0.0757 & 0.9199 & -1.9746 \\ 0.1516 & -1.9746 & 5.1135 \end{bmatrix} \begin{bmatrix} 93.1584 \\ 10.448 \\ 1.296 \end{bmatrix} = \begin{bmatrix} 0.0060 \\ 0.0017 \\ 0.1228 \end{bmatrix}$$

Eq. 19 $$x_r = \frac{-b + \sqrt{b^2 - \left[4a \times (c - OAF_r)\right]}}{2a} = \frac{-0.0017 + \sqrt{0.0017^2 - \left[4 \times 0.006 \times (0.1228 - 0.2)\right]}}{2 \times 0.006} = 3.46\ V$$

*FIG. 10*

| Evaporator Entering Mixed-Air Wetbulb Temperature, $t^*_m$ (°F) | Evaporator Entering Mixed-Air Drybulb Temperature, $t_m$ (°F) | | | | | | | | | | | | | | | | | | | | | | | |
|---|---|---|---|---|---|---|---|---|---|---|---|---|---|---|---|---|---|---|---|---|---|---|---|---|
| | 62 | 63 | 64 | 65 | 66 | 67 | 68 | 69 | 70 | 71 | 72 | 73 | 74 | 75 | 76 | 77 | 78 | 79 | 80 | 81 | 82 | 83 | 84 | |
| 50 | 17.1 | 17.5 | 18.0 | 18.5 | 18.9 | 19.4 | 19.9 | 20.4 | 20.9 | 21.4 | 21.9 | 22.5 | 23.0 | 23.6 | 24.1 | | | | | | | | | 50 |
| 51 | 16.7 | 17.2 | 17.6 | 18.1 | 18.6 | 19.1 | 19.6 | 20.1 | 20.7 | 21.3 | 21.8 | 22.4 | 22.9 | 23.5 | 24.0 | 24.6 | | | | | | | | 51 |
| 52 | 16.6 | 17.0 | 17.5 | 18.0 | 18.5 | 19.0 | 19.5 | 20.0 | 20.6 | 21.1 | 21.7 | 22.2 | 22.8 | 23.3 | 23.9 | 24.4 | | | | | | | | 52 |
| 53 | 16.4 | 16.9 | 17.4 | 17.9 | 18.4 | 18.9 | 19.4 | 19.9 | 20.4 | 20.9 | 21.5 | 22.0 | 22.6 | 23.1 | 23.7 | 24.2 | 24.7 | | | | | | | 53 |
| 54 | 16.0 | 16.5 | 17.0 | 17.5 | 18.0 | 18.5 | 19.0 | 19.6 | 20.1 | 20.7 | 21.2 | 21.8 | 22.3 | 22.9 | 23.4 | 24.0 | 24.5 | | | | | | | 54 |
| 55 | 15.6 | 16.1 | 16.6 | 17.1 | 17.6 | 18.2 | 18.7 | 19.3 | 19.9 | 20.4 | 20.9 | 21.5 | 22.0 | 22.6 | 23.1 | 23.7 | 24.2 | 24.8 | | | | | | 55 |
| 56 | 15.1 | 15.6 | 16.2 | 16.7 | 17.2 | 17.8 | 18.4 | 18.9 | 19.5 | 20.1 | 20.6 | 21.2 | 21.7 | 22.2 | 22.8 | 23.3 | 23.9 | 24.4 | 25.0 | | | | | 56 |
| 57 | 14.5 | 15.0 | 15.6 | 16.1 | 16.7 | 17.3 | 17.9 | 18.5 | 19.1 | 19.7 | 20.2 | 20.8 | 21.3 | 21.9 | 22.4 | 22.9 | 23.5 | 24.0 | 24.6 | 25.1 | | | | 57 |
| 58 | 14.0 | 14.5 | 15.1 | 15.7 | 16.3 | 16.9 | 17.5 | 18.1 | 18.7 | 19.3 | 19.8 | 20.3 | 20.9 | 21.4 | 22.0 | 22.5 | 23.1 | 23.6 | 24.2 | 24.7 | 25.2 | | | 58 |
| 59 | 13.4 | 13.9 | 14.5 | 15.1 | 15.7 | 16.3 | 17.0 | 17.6 | 18.2 | 18.8 | 19.3 | 19.9 | 20.4 | 21.0 | 21.5 | 22.0 | 22.6 | 23.1 | 23.7 | 24.2 | 24.8 | 25.3 | 25.9 | 59 |
| 60 | | 13.6 | 14.1 | 14.7 | 15.3 | 15.9 | 16.5 | 17.1 | 17.7 | 18.3 | 18.8 | 19.4 | 19.9 | 20.4 | 21.0 | 21.5 | 22.1 | 22.6 | 23.2 | 23.7 | 24.2 | 24.8 | 25.3 | 60 |
| 61 | | | 13.5 | 14.1 | 14.7 | 15.3 | 15.9 | 16.5 | 17.2 | 17.7 | 18.2 | 18.8 | 19.3 | 19.9 | 20.4 | 21.0 | 21.5 | 22.1 | 22.6 | 23.1 | 23.7 | 24.2 | 24.8 | 61 |
| 62 | | | | 13.4 | 14.0 | 14.6 | 15.3 | 15.9 | 16.5 | 17.1 | 17.6 | 18.2 | 18.7 | 19.3 | 19.8 | 20.4 | 20.9 | 21.4 | 22.0 | 22.5 | 23.1 | 23.6 | 24.2 | 62 |
| 63 | | | | | 13.2 | 13.9 | 14.5 | 15.2 | 15.9 | 16.4 | 17.0 | 17.5 | 18.1 | 18.6 | 19.2 | 19.7 | 20.2 | 20.8 | 21.3 | 21.9 | 22.4 | 23.0 | 23.5 | 63 |
| 64 | | | | | | 13.3 | 13.9 | 14.5 | 15.2 | 15.7 | 16.3 | 16.8 | 17.4 | 17.9 | 18.5 | 19.0 | 19.5 | 20.1 | 20.6 | 21.2 | 21.7 | 22.3 | 22.8 | 64 |
| 65 | | | | | | | 13.1 | 13.7 | 14.4 | 15.0 | 15.5 | 16.1 | 16.6 | 17.2 | 17.7 | 18.3 | 18.8 | 19.3 | 19.9 | 20.4 | 21.0 | 21.5 | 22.1 | 65 |
| 66 | | | | | | | | 12.9 | 13.7 | 14.2 | 14.7 | 15.3 | 15.8 | 16.4 | 16.9 | 17.5 | 18.0 | 18.5 | 19.1 | 19.6 | 20.2 | 20.7 | 21.3 | 66 |
| 67 | | | | | | | | | 12.8 | 13.4 | 13.9 | 14.4 | 15.0 | 15.5 | 16.1 | 16.6 | 17.2 | 17.7 | 18.3 | 18.8 | 19.3 | 19.9 | 20.4 | 67 |
| 68 | | | | | | | | | | 12.5 | 13.0 | 13.6 | 14.1 | 14.7 | 15.2 | 15.7 | 16.3 | 16.8 | 17.4 | 17.9 | 18.5 | 19.0 | 19.5 | 68 |
| 69 | | | | | | | | | | | 12.1 | 12.6 | 13.2 | 13.7 | 14.3 | 14.8 | 15.4 | 15.9 | 16.4 | 17.0 | 17.5 | 18.1 | 18.6 | 69 |
| 70 | | | | | | | | | | | | 11.7 | 12.2 | 12.7 | 13.3 | 13.8 | 14.4 | 14.9 | 15.5 | 16.0 | 16.6 | 17.1 | 17.6 | 70 |
| 71 | | | | | | | | | | | | | 11.2 | 11.7 | 12.3 | 12.8 | 13.4 | 13.9 | 14.4 | 15.0 | 15.5 | 16.1 | 16.6 | 71 |
| 72 | | | | | | | | | | | | | | 10.7 | 11.2 | 11.7 | 12.3 | 12.8 | 13.4 | 13.9 | 14.5 | 15.0 | 15.6 | 72 |
| 73 | | | | | | | | | | | | | | | 10.1 | 10.6 | 11.2 | 11.7 | 12.3 | 12.8 | 13.4 | 13.9 | 14.4 | 73 |
| 74 | | | | | | | | | | | | | | | | 9.5 | 10.0 | 10.6 | 11.1 | 11.7 | 12.2 | 12.7 | 13.3 | 74 |
| 75 | | | | | | | | | | | | | | | | | 8.8 | 9.4 | 9.9 | 10.4 | 11.0 | 11.5 | 12.1 | 75 |
| 76 | | | | | | | | | | | | | | | | | | 8.1 | 8.7 | 9.2 | 9.7 | 10.3 | 10.8 | 76 |
| | 62 | 63 | 64 | 65 | 66 | 67 | 68 | 69 | 70 | 71 | 72 | 73 | 74 | 75 | 76 | 77 | 78 | 79 | 80 | 81 | 82 | 83 | 84 | |
| | Evaporator Entering Mixed-Air Drybulb Temperature, $t_m$ (°F) | | | | | | | | | | | | | | | | | | | | | | | |

*FIG. 11*

APPARATUS AND METHODS TO DETERMINE ECONOMIZER FAULTS

CROSS-REFERENCE TO RELATED APPLICATIONS

The present application is a Continuation In Part of U.S. patent application Ser. No. 15/169,586 filed May 31, 2016, which application is incorporated in its entirety herein by reference.

BACKGROUND OF THE INVENTION

The present invention relates to Heating, Ventilating, and Air Conditioning (HVAC) systems and in particular to outdoor air introduced into buildings during HVAC operation through economizer dampers or non-economizer dampers.

Buildings are required to provide a minimum flow of outdoor air into their HVAC systems per the American Society of Heating Refrigeration and Air-Conditioning Engineers (ASHRAE) Standard 61.1 (ANSI/ASHRAE 62.1-2010. Standard Ventilation for Acceptable Indoor Air Quality) and the California Energy Commission (CEC) Building Energy Efficiency Standards for Residential and Nonresidential Buildings (CEC-400-2012-004-CMF-REV2). When the outdoor airflow exceeds the minimum required airflow, the additional airflow may introduce unnecessary hot outdoor air when the HVAC system is cooling the building, or introduce unnecessary cold outdoor air when the HVAC system is heating the building. This unnecessary or unintended outdoor airflow reduces space cooling and heating capacity and efficiency and increases cooling and heating energy consumption and the energy costs required to provide space cooling and heating to building occupants. Known methods for measuring the amount of outdoor airflow introduced into buildings to meet minimum requirements are inaccurate and better methods are required to improve thermal comfort of occupants, reduce cooling and heating energy usage, and improve cooling and heating energy efficiency.

U.S. Pat. No. 6,415,617 (Seem 2002) discloses a method for controlling an air-side economizer of an HVAC system using a model of the airflow through the system to estimate building cooling loads when minimum and maximum amounts of outdoor air are introduced into the building and uses the model and a one-dimensional optimization routine to determine the fraction of outdoor air that minimizes the load on the HVAC system. The '617 patent does not provide apparatus or methods to measure the Outdoor Air Fraction (OAF) defined as the ratio of outdoor airflow through the economizer or non-economizer dampers to total system airflow. Nor does the '617 patent provide methods to adjust the economizer outdoor air damper minimum damper position until OAF is within the allowable minimum regulatory requirement.

US Patent Application Publication No. 2015/0,309,120 (Bujak 2015) discloses a method to evaluate economizer damper fault detection for an HVAC system including moving dampers from a baseline position to a first damper position and measuring the fan motor output at both positions to determine successful movement of the baseline to first damper position. The '120 publication does not teach how to measure the OAF or electronically control the actuator to adjust the economizer outdoor air damper minimum damper position until OAF is within the allowable minimum regulatory requirement.

U.S. Pat. No. 7,444,251 (Nikovski 2008) discloses a system and method to detect and diagnose faults in HVAC equipment using internal state variables under external driving conditions using a locally weighted regression model and differences between measured and predicted state variables to determine a condition of the HVAC equipment. The '251 patent does not provide apparatus or methods to measure the OAF. The '251 patent does not provide apparatus or methods to measure the OAF. Nor does the '251 patent provide methods to adjust the economizer outdoor air damper minimum damper position until OAF is within the allowable minimum regulatory requirement or measure the temperature difference across the evaporator or heat exchanger to determine whether or not the sensible cooling or heating capacities are within tolerances.

U.S. Pat. No. 6,223,544 (Seem 2001) discloses an integrated control and fault detection system using a finite-state machine controller for an air handling system. The '544 method employs data regarding system performance in the current state and upon a transition occurring, determines whether a fault exists by comparing actual performance to a mathematical model of the system under non-steady-state operation. The '544 patent declares a fault condition in response to detecting an abrupt change in the residual which is a function of at least two temperature measurements including: outdoor-air, supply-air, return-air, and mixed-air temperatures. The '544 patent measures the mixed-air temperature with a single-sensor and without a minimum temperature difference between outdoor and return air temperatures. The '544 patent does not provide apparatus or accurate methods to measure the OAF. Nor does the '544 patent provide methods to adjust the economizer outdoor air damper minimum damper position until the OAF is within the allowable minimum regulatory requirement or measure the temperature difference across the evaporator or heat exchanger to determine whether or not the sensible cooling or heating capacities are within tolerances.

Carrier. 1995. HVAC Servicing Procedures. SK29-01A, 020-040 (Carrier 1995). The Carrier 1995, page 149-150, describes the "Proper Airflow Method" (pp. 7-8 of PDF) based on measuring temperature split and hereinafter referred to as the Temperature Split (TS) method. The TS method focuses entirely on measuring temperature split to determine if there is proper airflow and does not mention that temperature split can be used to detect low cooling capacity or other faults. The TS method is recommended after the superheat (non-TXV) or subcooling (TXV) refrigerant charge diagnostic methods are performed (pp. 145-149). The TS method was first required in the 2000 CEC Title 24 standards, only to check for proper airflow not for proper cooling capacity.

California Energy Commission (CEC). 2008. 2008 Residential Appendices for the Building Energy Efficiency Standards for Residential and Nonresidential Buildings. CEC-400-2008-004-CMF, California Energy Commission, Sacramento, Calif.: pp. RA3-9 to RA3-24 (CEC 2008). The CEC 2008 report provides a Refrigerant Charge Airflow (RCA) protocol disclosed in the Carrier 1995 HVAC Servicing Procedures document and defined in Appendix RA3 of the CEC 2008 Building Energy Efficiency Standards, which is a California building energy code. The Temperature Split (TS) method is used to check for minimum airflow across the evaporator coil in cooling mode per pp. RA3-15, Section RA3.2.2.7 Minimum Airflow.

> "The temperature split test method is designed to provide an efficient check to see if airflow is above the required minimum for a valid refrigerant charge test."

In 2013, the CEC adopted the 2013 Building Energy Efficiency Standards and no longer allowed the TS method to check for minimum airflow due to the perceived inaccuracy of the TS method as disclosed in the Yuill 2012 report.

Yuill, David P. and Braun, James E., 2012. "Evaluating Fault Detection and Diagnostics Protocols Applied to Air-Cooled Vapor Compression Air-Conditioners." International Refrigeration and Air Conditioning Conference. Paper 1307. http://docs.lib.purdue.edu/iracc/1307. (Yuill 2012). The Yuill 2012 report evaluated the Refrigerant Charge Airflow (RCA) protocol including the TS method specified in the Appendix RA3 of the CEC 2008 Building Energy Efficiency Standards, which is the California building energy code. Yuill applied the TS method to cooling mode air-conditioners to determine whether an Evaporator Airflow fault (EA) is present, and if none is present to determine whether a refrigerant charge fault is present (UC or OC). Yuill 2012 evaluated the accuracy of correctly diagnosing Evaporator Airflow (EA) faults from −90% to −10% of proper airflow (equivalent to 10% to 90% of proper airflow.) Page 7 of the Yuill 2012 report makes the following statement:

> "The results, overall, seem quite poor. About half of the times it's applied, the RCA protocol gives a correct result. The most serious problems are the high rates of False Alarm and Misdiagnosis (30% and 33%), because each of these outputs will result in costly and unnecessary service when the protocol is deployed. In practice, users of FDD on unitary equipment commonly have no tolerance for False Alarms, but are quite tolerant of Missed Detections, so it could be concluded that this protocol is overly sensitive."

Yuill reported that the TS method was 100% accurate for diagnosing low airflow from −90% to −50% (i.e., 10% to 50% of proper airflow), but the accuracy was unacceptable for diagnosing low airflow from −40% to −10% (i.e., 60% to 90% of proper airflow). The Yuill 2012 report identified:

> "a great need for a standardized method of evaluation, because it is likely that better-performing methods currently exist, or could be developed, and could take the place of RCA, but with no method of evaluating them it is impossible to know what those methods are."

Based on the Yuill 2012, the CEC, HVAC industry experts, and persons having ordinary skill in the art no longer recommended using the TS method for checking "proper airflow" or any other fault. In 2013, the CEC Title 24 standards mentioned the TS method, but did not allow this method to be used for field verification of proper airflow. Nor did the CEC recommend using the TS method to check low capacity or other faults. Instead the CEC required other methods for field verification of proper airflow. From 2000 through 2017, the CEC has not recommended or required using the TS method to diagnose low capacity faults caused by low refrigerant charge, dirty air filters, blocked evaporator/condenser coils, low refrigerant charge, iced evaporator, faulty expansion device, restrictions, non-condensables, duct leakage, excess outdoor airflow or low thermostat setpoint, then longer compressor operation will result which wastes energy.

California Energy Commission. 2012. Reference Appendices The Building Energy Efficiency Standards for Residential and Nonresidential Buildings. CEC-400-2012-005-CMF-REV3. (CEC 2012). CEC 2012 reference appendices of the building standards page RA3-27-28 require the following methods to measure airflow: 1) supply plenum pressure measurements are used for plenum pressure matching (fan flow meter), 2) flow grid measurements (pitot tube array "TrueFlow"), 3) powered-flow capture hood, or 4) traditional flow capture hood (balometer) methods to verify proper airflow. CEC 2012 required supply plenum pressure measurements to be taken at the supply plenum measurement access locations shown in Figure RA3.3-1. These holes were previously used to measure Temperature Split (TS), but TS is not required since the CEC and persons having ordinary skill in the art do not believe the TS method provides useful information.

R. Mowris, E. Jones, R. Eshom, K. Carlson, J. Hill, P. Jacobs, J. Stoops. 2016. Laboratory Test Results of Commercial Packaged HVAC Maintenance Faults. Prepared for the California Public Utilities Commission. Prepared by Robert Mowris & Associates, Inc. (RMA 2016). The RMA 2016 laboratory study states that the TS method was accurate 90% of the time when diagnosing low airflow (cfm) and low cooling capacity (Btu/hr) faults including excess outdoor air ventilation, blocked air filters or coils, restrictions, non-condensables, low refrigerant charge, or other cooling system faults. Page iii of the RMA 2016 abstract makes the following statement.

> "The CEC temperature split protocol average accuracy was 90+/−2% based on 736 tests of faults causing low airflow or low capacity."

The prior art does not disclose a method or a need to use the TS method to diagnose a low capacity fault based on excess outdoor air ventilation, blocked air filters or coils, low refrigerant charge, restrictions, non-condensables, or other cooling system faults. Due to the poor performance of the TS method for checking low airflow from −10 to −40% as disclosed by Yuill 2012, starting in 2013, the CEC no longer requires using the TS method to check minimum airflow. Instead the CEC requires direct measurement of airflow using one of the following methods: 1) supply plenum pressure (fan flow meter), 2) flow grid measurements (pitot tube array "TrueFlow"), 3) powered-flow capture hood, or 4) traditional flow capture hood (balometer).

U.S. Pat. No. 7,500,368 filed in 2004 and issued in 2009 to Robert Mowris (Mowris '368) discloses a method for correcting refrigerant charge (col 13:1-16).

> "if the delta temperature split is less than minus the delta temperature split threshold, and the air conditioning system is not a Thermostatic Expansion Valve (TXV) system: computing one of the a refrigerant undercharge and a refrigerant overcharge based on a superheat temperature; if the delta temperature split is less than minus the delta temperature split threshold, and the air conditioning system is the TXV system: computing one of the refrigerant undercharge and the refrigerant overcharge based on subcooling temperature; and adjusting the amount of refrigerant in the air conditioning system based on one of the refrigerant undercharge and the refrigerant overcharge."

The Mowris '368 patent thus discloses a method to compute a refrigerant undercharge or overcharge based on superheat (non-TXV) or subcooling (TXV).

U.S. Pat. No. 8,066,558 (Thomle '558) discloses a method for demand control ventilation to address the issue of temperature sensor failure using an occupancy indicator such that if a temperature sensor measurement is determined to be incorrect, unexpected or otherwise erroneous, the ventilation system can provide an amount of fresh air sufficient for adequate ventilation without over-ventilating a building.

U.S. Pat. No. 8,195,335 (Kreft '335) discloses a method for controlling an economizer of an HVAC system with an outside air stream, a return air stream, and a mixed air stream to provide outdoor air cooling to an HVAC system. The economizer includes one or more controllable outdoor air dampers for controlling a mixing ratio of incoming outside air to return air in the mixed air stream. The control method includes positioning the one or more controllable dampers in first and second configurations such that the mixed air stream has first and second mixing ratios of incoming outside air to return air in the mixed air stream. The method also includes recording first and second measures related to the temperature of the mixed air stream when the dampers are in each of the first and second configurations and based on the recorded first and second measures related to the temperature of the mixed air stream and possibly other recorded measures related to mixed air stream parameters, the method determines whether and/or how much of the incoming outside air to admit into the economizer via the one or more controllable outdoor air dampers.

U.S. Patent Application Publication No. 2014/0207288 (Belim o '288) discloses a control unit for an HVAC system comprising an economizer configured to introduce outdoor air into the HVAC system for cooling and/or ventilation purposes where the economizer is controlled by a control unit comprising a base module with: a control circuit, an interface, and first I/O means for connecting at least one sensor of the HVAC system to control circuit for delivering at least one control signal from the control circuit to control the operation of the economizer where the base module is configured to optionally receive at least one extension module, which can be snapped on and electrically connected to the base module for expanding the functionality of the control unit.

U.S. Pat. No. 5,998,995 A (Oslander '995). Oslander '995 describes a Micro-Electro-Mechanical System (MEMS) magnetostrictive magnetometer that uses, as an active element, a commercial (001) silicon microcantilever coated with an amorphous thin film of the giant magnetostrictive alloy Terfenol-D and a compact optical beam deflection transduction scheme. A set of Helmholtz coils is used to create an AC magnetic excitation field for driving the mechanical resonance of the coated microcantilever. When the coated microcantilever is placed in a DC magnetic field, the DC field will change the amplitude at the mechanical resonance of the coated microcantilever thereby causing a deflection that can be measured. The magnetometer has been demonstrated with a sensitivity near 1 μT.

U.S. Pat. No. 7,046,002 (Edelstein '002). Edelstein '002 describes a Micro-Electro-Mechanical System (MEMS) device comprising a base structure; a magnetic sensor attached to the base structure and operable for sensing a magnetic field and allowing for a continuous variation of an amplification of the magnetic field at a position at the magnetic sensor; and for receiving a DC voltage and an AC modulation voltage in the MEMS sensor or device; a pair of flux concentrators attached to the magnetic sensor; and a pair of electrostatic comb drives, each coupled to a respective flux concentrator such that when the pair of electrostatic comb drives are excited by a modulating electrical signal, each flux concentrator oscillates linearly at a prescribed frequency; and a pair of bias members (mechanical spring connectors) connecting the flux concentrators to one another.

U.S. Pat. No. 6,215,318 (Schoefthaler '318). Schoefthaler '318 describes a MEMS magnetic field sensor including a printed circuit trace device, which is suspended above a substrate and is capable of being deflected elastically. Also included are a first capacitor plate device that is joined to the printed circuit trace device and is able to be deflected together with the printed circuit trace device, and a second, fixed capacitor plate device that is joined to the substrate and forms a capacitor device by interacting with the first capacitor plate device. A magnetic field sensing device conducts a predetermined current through the printed circuit trace device and measures the change in capacitance of the capacitor device arising in dependence on an applied magnetic field. The magnetic field sensing device can also be designed in such a way that it can be calibrated by calibration current loops.

U.S. Pat. No. 7,895,892 (Aigner '892). Aigner '892 describes a Micro-Electro-Mechanical Systems (MEMS) rotation sensor with a substrate and a first surface and a second surface. A shear-wave transparent mirror is arranged on the first surface of the substrate, and a shear-wave isolator is arranged above the shear-wave transparent mirror, the shear-wave transparent mirror and the shear-wave isolator being arranged separated from each other to define a Coriolis zone there between. A bulk-acoustic-wave resonator is arranged above the shear-wave isolator, and a shear-wave detector is arranged on the substrate in a direction, in which a shear-wave generated by the bulk-acoustic-wave resonator upon rotation propagates.

U.S. Pat. No. 6,131,457 (Sato '457). Sato '457 describes a MEMS three-dimensional acceleration sensor having a magnetic body including a mass point, mounted to a vibrator having three-dimensional freedom and an axis in line with a Z-axis within the orthogonal spatial coordinate axes of X, Y and Z. The acceleration sensor includes four or more detector elements including at least two positioned along the X-axis and at least two positioned along the Y-axis with their centers located along a concentric circle around the origin point of the coordinate axes. The sensor detects acceleration in a direction of the X-axis through a relative difference in output voltage between two of the detector elements positioned along the X-axis due to a variation of magnetic field intensity from the magnetic body, acceleration in a direction of the Y-axis through a relative difference in output voltage between two of the detector elements positioned along the Y-axis, and acceleration in a direction of the Z-axis through an aggregate sum of the output voltages of all the detector elements. The acceleration sensor thus has a wide dynamic range as well as high detection accuracy, and may be produced having a reduced size.

U.S. Pat. No. 7,131,998 (Pasolini '998). Pasolini '998 describes a device for measuring the relative angular position of two bodies with respect to a point is provided with a first measuring element and a second measuring element, relatively movable with respect to one another and connectable to a first body and a second body, respectively; the first measuring element includes a first inclination sensor, which has a first detection axis and supplies a first inclination signal, correlated to a first angle of inclination of the first detection axis with respect to a reference axis, and the second measuring element includes a second inclination sensor, which has a second detection axis and supplies a second inclination signal, correlated to a second angle of inclination of the second detection axis with respect to the reference axis.

U.S. Patent Application Publication No. US20050253710 (Eskildsen '710). Eskildsen '710 describes a MEMS-based overhead garage door intrusion sensor for a security system, such as a residential/home security system, for detecting an intrusion through an overhead garage door. In one embodiment, a MEMS sensor accelerometer is mounted with a sensitive axis of the MEMS device, along which the MEMS device measures acceleration/gravity, pointing vertically downward towards the earth when the overhead garage door is closed, such that the MEMS sensor measures a 1 g acceleration/gravity force, and when the overhead garage door is open, the sensitive axis of the MEMS device points horizontally with respect to the earth, such that the MEMS sensor measures a 0 g acceleration/gravity force, such that the output of the MEMS sensor, indicating either a 1 g or a 0 g measured acceleration/gravity force, indicates whether the overhead garage door is respectively closed or open. Alternatively, the MEMS sensor can be a MEMS switch. An ASIC or microcontroller can monitor the output of the MEMS sensor, and one embodiment employs wireless RF technology.

California Energy Commission. 2016. Reference Appendices the Building Energy Efficiency Standards for Residential and Nonresidential Buildings. JUNE 2015 CEC-400-2015-038-CMF. (CEC 2016). The CEC 2016 Reference Appendices of the Building Standards JA6.3 Economizer Fault Detection and Diagnostics (pp. JA6-7 through JA6-12), requires economizer controllers to be capable of detecting the following faults: 1) air temperature sensor failure/fault, 2) not economizing when it should, 3) economizing when it should not, 4) damper not modulating and 5) excess outdoor air. However, the CEC 2016 does not describe methods to diagnose or evaluate these faults. Therefore, an unresolved need remains to develop apparatus and methods for evaluating economizer faults to improve HVAC energy efficiency.

BRIEF SUMMARY OF THE INVENTION

The present invention meets an unresolved need to detect the following economizer faults listed in the California Energy Commission Title 24 building standard which require Fault Detection Diagnostics (FDD) for economizers: 1) air temperature sensor failure/fault, 2) not economizing when it should, 3) economizing when it should not, 4) damper not modulating, 5) excess outdoor air, 6) economizer dampers stuck in the open, minimum, or closed position, 7) bad or unplugged actuator and 8) actuator mechanically disconnected.

The present invention can also detect cooling or heating system not operating properly or delivering less than optimal performance. The present invention provides apparatus and/or methods to measure damper position based on inertial sensor measurements combined with data from temperature sensor measurements to perform FDD for economizers to meet the CEC Title 24 building standard requirements.

The present invention meets an unresolved need for apparatus and/or methods to detect absolute damper position and/or whether or not an economizer damper is stuck open or stuck closed. The present invention discloses a method to detect the outdoor air damper position using at least four types of inertial sensor methods: 1) magnetometers, 2) accelerometers, 3) Inertial Measurement Units (IMU) and 4) rotation or angular position sensors (hereinafter referred to as "rotatiometers") wherein the inertial sensors use Micro-Electro-Mechanical Systems (MEMS) defined as miniaturized mechanical and electro-mechanical elements (i.e., devices and structures) that are made using the techniques of micro-fabrication. The magnetometer MEMS device is attached to a stationary frame of the economizer and a small permanent magnet is attached to the movable damper and when the damper moves from one position (i.e., closed) to another position (i.e., open) the magnetometer detects the magnitude and direction of the 3-dimensional permanent magnetic field (Gauss) from the magnet and from this information the magnetometer provides the damper position with respect to at least one reference or rotational position within a 3-dimensional coordinate system. The accelerometer method uses a MEMS device attached to a movable damper wherein the damper moves from one position (i.e., closed) to another position (i.e., open) and the gravitational vector shifts from at least one location within a 3-dimensional coordinate system to another location and the accelerometer detects this change and reports the absolute position of the damper within the 3-dimensional coordinate system. The IMU method uses a MEMS device attached to a movable damper wherein the damper moves from one position (i.e., closed) to another position (i.e., open) and the IMU uses miniature accelerometers and gyroscopes to sense angular motion from at least one location within a 3-dimensional coordinate system to another location and the IMU detects this change and reports the absolute position (i.e., orientation) of the damper within the 3-dimensional coordinate system. The rotatiometer uses a MEMS device attached to the economizer, damper or actuator and detects rotation of the damper or actuator from one rotational or angular position to another rotational or angular position with respect to at least one reference rotational or angular position.

The present invention addresses the above unresolved needs by providing apparatus and methods to accurately: 1) measure the outdoor airflow through economizer or non-economizer outdoor air dampers to determine outdoor airflow faults and establish a damper position to meet minimum outdoor airflow requirements without excess outdoor air; 2) measure and use temperature split to diagnose low cooling capacity or other faults; 3) measure and use temperature rise to diagnose low heating capacity or other faults; and 4) measure and use the absolute position of the outdoor air dampers to establish a damper position to meet minimum outdoor airflow requirements without excess outdoor air.

The present invention further addresses unresolved needs by providing apparatus and methods to perform FDD of HVAC systems and HVAC economizers based on measuring an Outdoor Air Temperature (OAT), a Return Air Temperature (RAT), a Mixed Air Temperature (MAT), a Supply Air Temperature (SAT), a Heat Exchanger Temperature (HXT), a Refrigerant Temperature (RT), a Refrigerant Pressure (RP), a Relative Humidity (RH) and an outdoor air damper position.

The present invention discloses methods to accurately measure and establish the Outdoor Air Fraction (OAF). The OAF is defined as the ratio of outdoor airflow through the economizer or non-economizer outdoor air dampers (i.e., louvers) and/or cabinet, to the total airflow introduced into the air conditioner evaporator or heat exchanger. The correct economizer damper position can be determined either manually or automatically using an economizer FDD controller and actuator to meet the ASHRAE minimum outdoor airflow requirements. Optimizing the OAF will improve space cooling and heating efficiency, save energy, and reduce carbon dioxide emissions.

The present invention discloses a method for determining the OAF and the mixed-air humidity ratio and mixed-air wetbulb temperature, for packaged and split-system HVAC equipment equipped with economizer or non-economizer outdoor air dampers. An outdoor airflow exceeding the ASHRAE Standard 62.1 minimum outdoor air requirements wastes space cooling and heating energy and increases carbon dioxide emissions contributing to global warming. The OAF measurements are used to optimize the minimum economizer or non-economizer outdoor air damper position to meet but not exceed ASHRAE 62.1 minimum outdoor airflow requirements. The present invention provides a method to measure OAF versus damper actuator voltage at the initial damper position, fully-open-damper maximum damper position, and closed-damper position. The present invention uses these measurements and matrix algebra to calculate coefficients for a quadratic regression equation of OAF versus control voltage in order to establish the optimal economizer damper position actuator control voltage to adjust the damper to achieve the optimally minimum OAF to just meet outdoor airflow regulatory requirements to reduce over ventilation and save energy. After the economizer damper position is verified to be within the accepted tolerance of the required minimum OAF, per regulatory standards, the mixed-air wetbulb temperature is determined to measure evaporator entering air drybulb and wetbulb temperatures and supply air drybulb temperature to evaluate temperature split, sensible cooling or heating capacity, and refrigerant charge FDD in order to determine whether or not the evaporator airflow, sensible cooling or heating capacity, and refrigerant charge of the air conditioning system, needs to be adjusted or corrected.

The present invention discloses how measurements of low temperature split are useful for detecting low cooling capacity to meet an unresolved need for a simple and accurate method to diagnose low cooling capacity and alert technicians or occupants about the presence of low cooling capacity faults. This is important because low cooling capacity causes air conditioners to operate longer to satisfy the thermostat setpoint which causes increased energy and peak demand use during the summer cooling season which causes unintended consequences of electric power shortages and increased emissions of carbon dioxide or refrigerant which contribute to global warming. Low cooling capacity can be caused by many faults including: unintended excess outdoor air ventilation, improper damper position, improper economizer operation, duct leakage, blocked air filters or coils, restrictions, non-condensables, low refrigerant charge, refrigerant leaks, defective thermostats, capacitors, relays, contactors, motors, fans, expansion valves, reversing valves, compressors, or other cooling system faults.

The present invention meets an unresolved need for a simple low-cost method using temperature split to accurately detect low cooling capacity and the Mowris 2016 report provides evidence that the method using temperature split is 90% accurate at diagnosing low cooling capacity faults based on 736 laboratory tests. This is important because low cooling capacity causes air conditioners to operate longer to satisfy the thermostat setpoint which causes increased energy and peak demand use during the summer cooling season which causes unintended consequences of electric power shortages and increased emissions of carbon dioxide or refrigerant which contribute to global warming.

In accordance with one aspect of the invention, there is provided a method for accurately measuring mixed air temperature by positioning an averaging temperature sensor in the passage between the mixed air chamber of the HVAC system and the air conditioner evaporator and furnace/heat exchanger of the HVAC system. The averaging temperature sensor is preferably formed into a quasi-rectangular or quasi-circular spiral in the shape of the passage in order to measure the average temperature of air flowing through the mixed-air chamber from the return duct and the outdoor air dampers. The mixed-air drybulb temperature measurement is considered accurate when the difference between return drybulb temperature and outdoor air drybulb temperature is preferably at least 10 degrees Fahrenheit and more preferably at least 20 degrees Fahrenheit. OAF measurements made at lower temperature differences will have slightly lower accuracy.

In accordance with another aspect of the invention, there is provided a method for recursively computing mixed air humidity ratio $W^*_s$. An initial value of mixed air wetbulb temperature $t^*_m$ is made based on a drybulb temperature measurement. A saturation pressure at wetbulb temperature $p_{ws}$ is computed using the estimate of $t^*_m$. An updated value of $W^*_s$ is computed from $p_{ws}$. The process is repeated using updated value of $W^*_s$ until it converges.

In accordance with another aspect of the invention, there is provided a method for measuring the sensible temperature split across the evaporator in cooling mode or the sensible temperature rise across the heat exchanger in heating mode. The sensible temperature split for cooling, or for temperature rise for heating, can be used to evaluate over ventilation, airflow, sensible cooling capacity, sensible heating capacity, and/or refrigerant charge FDD information.

In accordance with another aspect of the invention, there is provided a method to use sensors to transmit temperature or humidity measurement data using wires or wirelessly to a device or controller in order to display, store, or use the data to measure the OAF or to provide measurement data to an economizer controller or outdoor air damper controller where the controller uses the data to calculate the measured OAF and compares the measured OAF to a minimum outdoor airflow specification for a building conditioned space and occupancy, and communicates a low-voltage signal to an actuator to energize the actuator to adjust the dam per position to establish an optimally minimum damper position to provide an OAF within tolerances of the minimum outdoor airflow based on regulatory requirements for a building conditioned space and occupancy.

In accordance with another aspect of the invention, the absolute economizer damper position can be detected using at least three types of inertial sensor methods: 1) magnetometers, 2) accelerometers, 3) Inertial Measurement Units (IMU) and 4) rotatiometers wherein the inertial sensors use Micro-Electro-Mechanical Systems (MEMS) defined as miniaturized mechanical and electro-mechanical elements (i.e., devices and structures) that are made using the techniques of micro-fabrication. The magnetometer or MEMS-based accelerometers sense the position of the economizer dampers without the use of a known position encoder embedded in a known actuator. Inertial sensors used in almost every cellular telephone including magnetometers and MEMS-based accelerometers, can be used to detect dam per position with respect to physical constants such as gravity and the earth's or other fixed position magnetic field. The accelerometer or IMU detects the position of economizer dampers based on shifting of the 9.81 $m/s^2$ gravity constant from an arbitrary initial plane on the sensor's X, Y, and Z axis to another plane as the dampers move from fully shut to fully open. The initial value of the gravitational relationship on all three axis can be stored with the dampers in the closed position, and then the dampers positioned to the fully open position and the relationship stored again. The exact position can then be calculated using simple trigonometry to extrapolate between the stored fully closed and fully open position. As long as the sensor position is fixed, the relationship with the acceleration of gravity will remain constant. The rotatiometer uses a MEMS device attached to the economizer, damper or actuator and detects rotation of the damper or actuator from one rotational or angular position to another rotational or angular position with respect to at least one reference rotational or angular position.

In accordance with another aspect of the present invention, the measured damper position based on inertial sensor measurements can be combined with data from temperature sensor measurements to detect the following economizer faults listed in the California Energy Commission Title 24 building standard which require fault detection diagnostics for economizers: 1) economizer dampers stuck in the open, minimum, or closed position, 2) bad or unplugged actuator, 3) sensor hard failure, 4) actuator mechanically disconnected, 5) air temperature sensor failure/fault, 6) not economizing when should, 7) economizing when should not, 8) damper not modulating, or 9) excess outdoor air. The present invention can also detect cooling or heating system not operating properly or delivering less than optimal performance.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 9 provides a chart showing the OAF versus economizer damper actuator control voltage on an HVAC system according to the present invention.

FIG. 10 shows a chart of damper position data, and equations 7, 9, 11, and 19, according to the present invention.

FIG. 11 shows a lookup table for calculating the target temperature split difference ($\delta T_t$) based on the evaporator entering mixed-air drybulb temperature, $t_m$, and evaporator entering mixed-air wetbulb temperature, $t^*_m$, according to the present invention.

Corresponding reference element numbers indicate corresponding components throughout several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement. Drybulb temperature measurements at indicated without asterisks and corresponding wetbulb temperatures are indicated by the addition of an asterisk.

Figure 1:
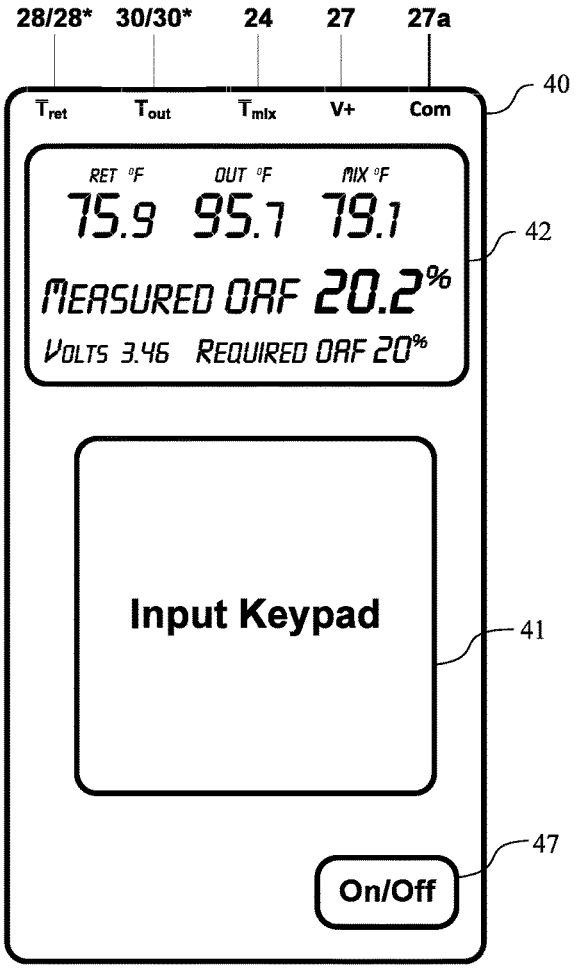
FIG. 1 shows a portable (for example, hand held) apparatus for measuring the outdoor air fraction (OAF) through economizer outdoor air dampers or manual outdoor air dampers.
Figure 2:
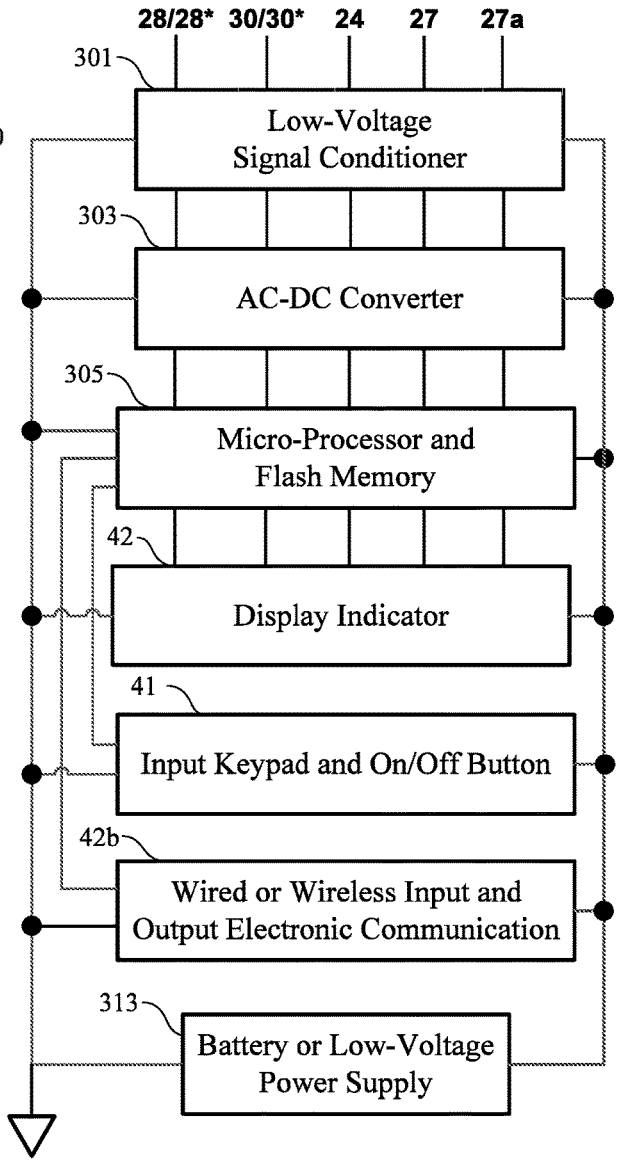
FIG. 2 shows the electronic components of a portable measurement instrument or control device mounted to an HVAC system for measuring OAF or evaluating HVAC FDD.
Figure 3:
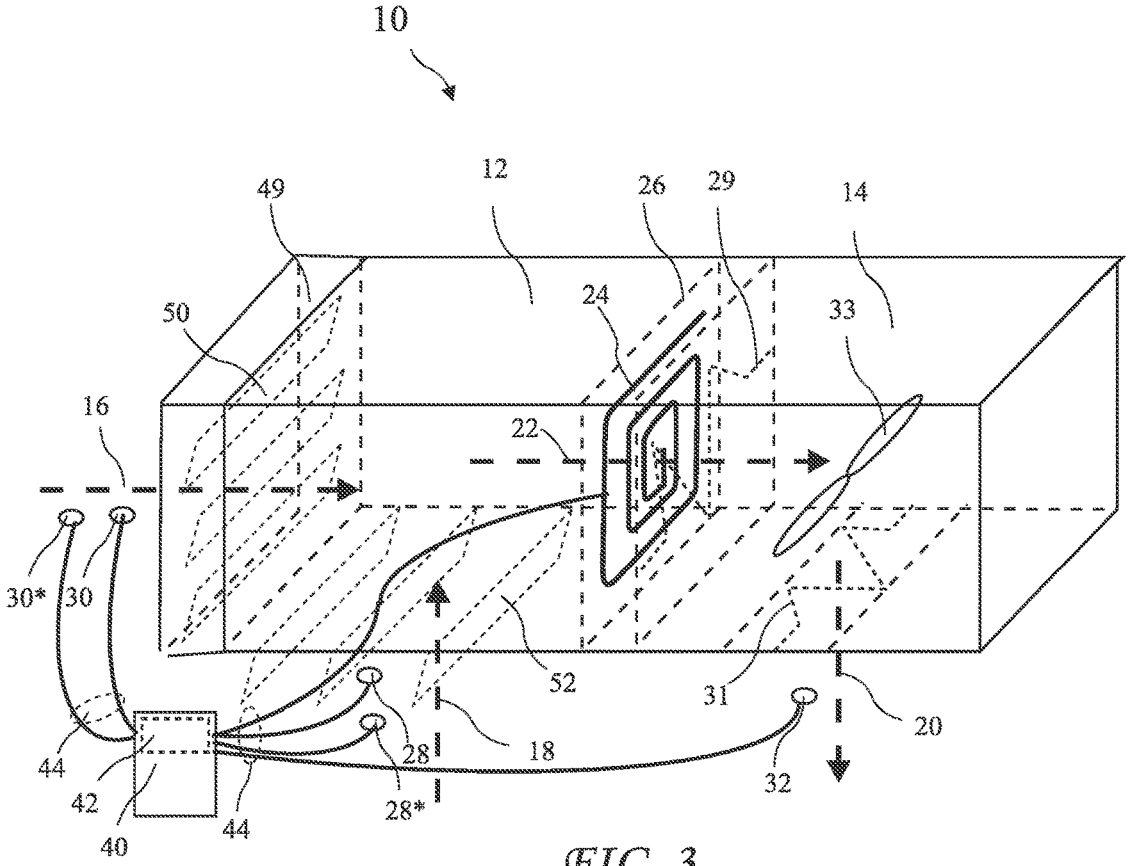
FIG. 3 shows an air handler of a Heating, Ventilation, and Air Conditioning (HVAC) system with manually adjusted outdoor air dampers according to the present invention with measurement instrument or controller capable of receiving measurements using either wired connections or wirelessly.
Figure 5:
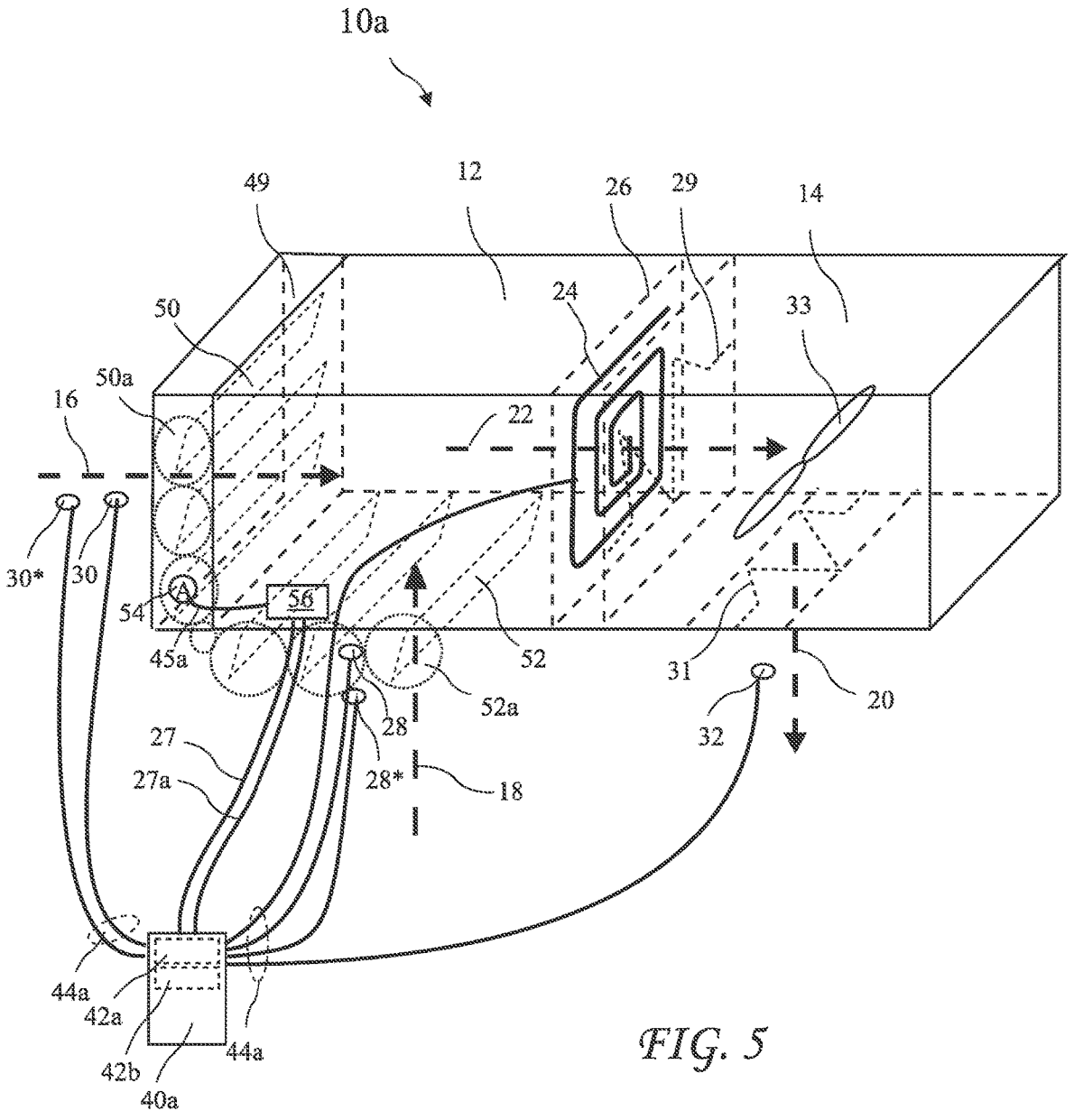
FIG. 5 shows the air handler of an HVAC system with an economizer controller and actuator used to adjust outdoor air dampers according to the present invention with measurement instrument or controller capable of receiving measurements using either wired connections or wirelessly.
Figure 6:
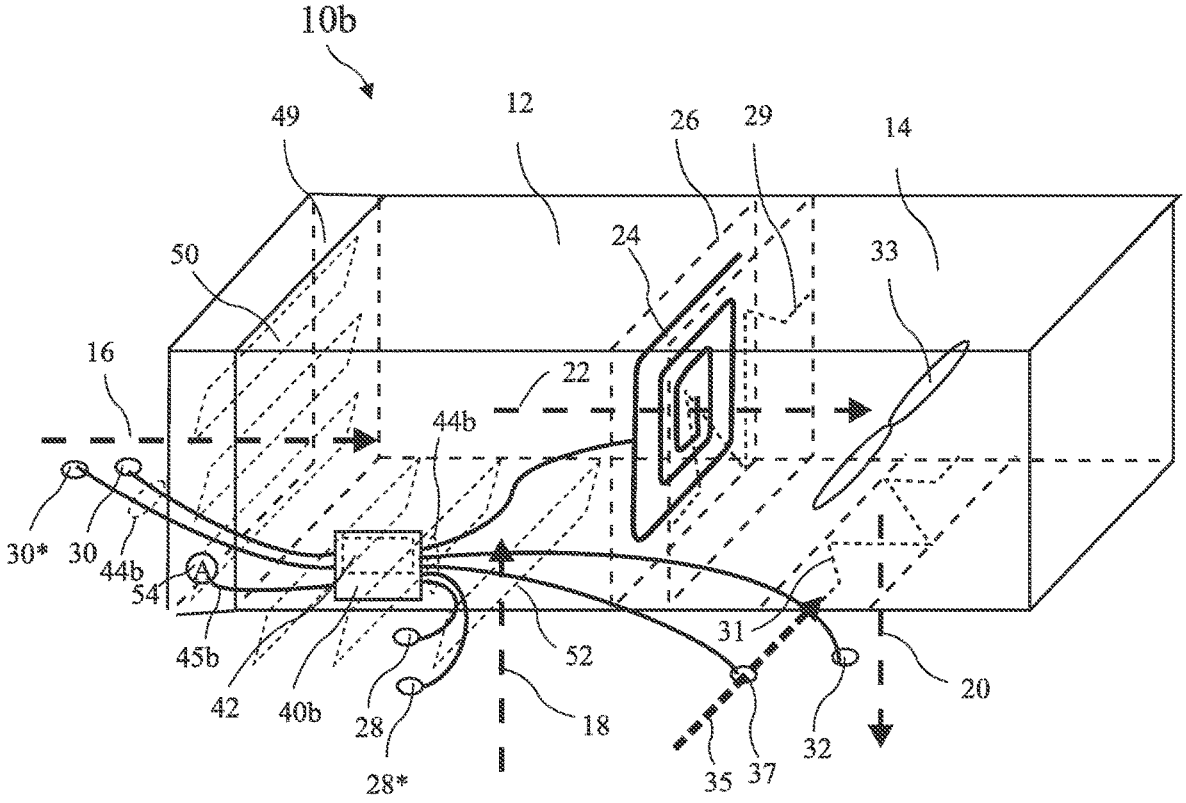
FIG. 6 shows the air handler of an HVAC system with an economizer controller and actuator used to adjust outdoor air dampers according to the present invention with measurement instrument or controller mounted on the HVAC hardware.

FIG. 1 shows a handheld measurement device 40 and FIG. 2 shows the electronic components of measurement devices 40, 40*a* or 40*b* (see FIGS. 3, 5 and 6). The measurement devices 40, 40*a* and 40*b* preferably include a low-voltage power supply or external power source 313, a signal conditioner 301, an ac-dc converter 303, microprocessor with flash memory 305, wireless communication electronic technology 42*b*, and a display 42 or 42*a* for receiving, processing, transmitting and displaying measurements from temperature sensors 24, 28, 28*, 30, 30*, and 32, and voltage 27 (see FIGS. 3, 5 and 6). The measurement device 40 may also provide an input keypad 41 to enter the required $OAF_r$ or other data, and a battery or a low-voltage power supply 313. The measurement devices 40*a* and 40*b* may also provide a low-voltage input 27 and a common input 27*a* to measure damper actuator voltage for controlling the position of outdoor air dampers (i.e., louvers) 50 and return air dampers (i.e., louvers) 52 shown in FIGS. 5 and 6.

Figure 4:
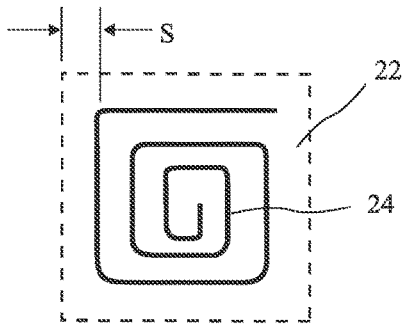
FIG. 4 shows an averaging temperature sensor formed into a quasi-rectangular or quasi-circular spiral in the shape of the passage according to the present invention.

An air handler 10 of a packaged Heating, Ventilation, Air Conditioning (HVAC) system with manually adjusted outdoor air dampers (i.e., louvers) 50 is shown in FIG. 3, and an averaging temperature sensor 24 is shown in FIG. 4 formed into a quasi-rectangular or quasi-circular spiral in the shape of the mixed-air passage 22. A flow of outdoor air 16 enters a mixed air chamber 12 of the air handler 10 through adjustable outdoor air dampers (i.e., louvers) 50. A flow of return air 18 enters a mixed air chamber 12 of the air handler 10 through adjustable return air dampers (i.e., louvers) 52. The outdoor air flow and return air flow combine in a mixed air flow 22 that flows through an air filter 26 and evaporator 29, and into a chamber 14 containing a draw-through blower fan 33 and gas or electric heat exchanger 31. A flow of heated or cooled air 20 is then provided through supply ducts to the conditioned space. The averaging temperature sensor 24 is located on the inlet side of the air filter 26 adjacent to the evaporator 29 of the mixed air passage. The averaging temperature sensor 24 is generally perpendicular to the path of mixed airflow 22, on the inlet of air filter and upstream of the evaporator 29, blower fan 33 and heat exchanger 31. The averaging temperature sensor 24 is used to measure the mixed-air drybulb temperature $t_m$.

The outdoor air dampers 50 and return air dampers 52 are coupled by a gear assembly so when outdoor air dampers 50 are opened, the return air dampers 52 close, and vice versa. Closing the outdoor air dampers 50 reduces the volumetric airflow rate of the outdoor air 16 into the mixed air chamber 12 and opens the dampers 52 to increase the volumetric airflow rate of return air 18 into the mixed air chamber 12. Preferably, the positions of the dampers 50 and the dampers 52 are coupled by the gear assemblies 50*a* and 52*a* so that opening the dampers 50 closes the dampers 52, and opening the dampers 52 closes the dampers 50, to maintain a generally consistent volumetric airflow rate into the mixed air chamber 12.

The temperature sensor 28 measures the return air drybulb temperature, $t_r$, and temperature sensor 30 measures the outdoor air drybulb temperature $t_o$. The temperature sensor 32 is used to measure the supply air drybulb temperature $t_s$, used with the return air drybulb or mixed air drybulb to calculate the temperature split decrease across the evaporator in cooling mode or the temperature split increase across the heat exchanger in heating mode. The mixed-air drybulb temperature, $t_m$, measurement is considered minimally accurate when the difference between return drybulb temperature, $t_r$, and outdoor air drybulb temperature, $t_o$, is preferably at least ten degrees Fahrenheit and is considered more accurate when the difference between return drybulb temperature, $t_r$, and outdoor air drybulb temperature, $t_o$, is at least 20 degrees Fahrenheit. The measurement device 40 (see FIG. 1) is connected to the sensors 24, 28, 30, and 32 by cables 44, or wirelessly communicates with the sensors 24, 28, 30, and 32. When the air handler 10 includes an actuator A to adjust outdoor air dampers 50 and return dampers 52 (see FIG. 5), the measurement device 40 may also provide low-voltage inputs to measure damper actuator voltage for controlling the position of outdoor air dampers 50 and return dampers 52.

The return air drybulb temperature $t_r$, and the return air wetbulb temperature $t^*_r$, are preferably measured in well-mixed return air. The outdoor air drybulb temperature $t_o$ and outdoor air wetbulb temperature $t^*_o$ are preferably measured in well-mixed outdoor air entering an economizer 49 controlling the outdoor air flow 16*b* into the mixed air chamber 12 through outdoor air dampers 50.

The averaging temperature sensor 24 shown in FIG. 4 is preferably a Resistance Temperature Detector (RTD) or thermistor or thermocouple sensor, preferably formed into a quasi-rectangular or quasi-circular spiral in the shape of the in the shape of the mixed-air passage 22 or the mixed-air chamber 12. The averaging temperature sensor 24 may further be an infrared averaging sensor or temperature sensor array consisting of one or more RTD, thermistors, or thermocouple sensors used to measure the mixed air drybulb temperature, $t_m$.

An air handler 10*a* of a packaged HVAC system with an economizer controller 56 and actuator 54 used to adjust outdoor air dampers is shown in FIG. 5. The flow of outdoor air 16 enters the mixed air chamber 12 of the air handler 10 through the adjustable dampers 50. The flow of return air 18 enters the mixed air chamber 12 of the air handler 10 through the adjustable dampers 52. The outdoor air flow and return air flow combine in the mixed air flow 22 that flows through the air filter 26 and the evaporator 29, and into the chamber 14 containing the draw-through blower fan 33 and the gas or the electric heat exchanger 31. The flow of heated or cooled air 20 is then provided through supply ducts to the conditioned space. The averaging temperature sensor 24 is located on the inlet side of the air filter 26 adjacent to the evaporator 29 of the mixed air passage. The averaging temperature sensor 24 is generally perpendicular to the path of mixed airflow 22, on the inlet of air filter and upstream of the evaporator 29, blower fan 33 and heat exchanger 31. The averaging temperature sensor 24 is used to measure the mixed-air drybulb temperature $t_m$.

FIG. 5 shows outdoor air dampers 50 and return air dampers 52 controlled and coupled by a gear assembly 50*a*, 52*a* and actuator 54 so when outdoor air dampers 50 are opened by the actuator, the return air dampers 52 close, and vice versa. The actuator 54 is controlled by a controller 56 using a voltage signal carried by a cable 45*a* and measured by the hand held measurement device 40*a* using a low-voltage sensor 27 and ground probe 27*a*. Closing the outdoor air dampers 50 reduces the volumetric airflow rate of the outdoor air 16 into the mixed air chamber 12 and opens the dampers 52 to increase the volumetric airflow rate of return air 18 into the mixed air chamber 12. Preferably, the positions of the dampers 50 and the dampers 52 are controlled and coupled by the gear assembly 50*a*, 52*a* so that opening the dampers 50 closes the dampers 52, and opening the dampers 52 closes the dampers 50, to maintain a generally consistent volumetric airflow rate into the mixed air chamber 12.

The sensor 28 measures the return air drybulb temperature, $t_r$, and the optional temperature sensor 28* measures the return air wetbulb temperature, $t^*_r$, respectfully. The temperature sensor 30 measures the outdoor air drybulb temperature, $t_o$, and the optional temperature sensor 30* measures the outdoor air wetbulb temperature, $t^*_o$, respectively. The temperature sensor 32 is used to measure the supply air drybulb temperature, $t_s$, used with the return air drybulb or mixed air drybulb to calculate the temperature split decrease across the evaporator in cooling mode or the temperature split increase across the heat exchanger in heating mode. The mixed-air drybulb temperature, $t_m$, measurement is considered minimally accurate when the difference between return drybulb temperature, $t_r$, and outdoor air drybulb temperature, $t_o$, is preferably at least ten degrees Fahrenheit and considered more accurate when the difference between return drybulb temperature, $t_r$, and outdoor air drybulb temperature, $t_o$, is at least 20 degrees Fahrenheit. FIG. 5 shows a portable (for example, hand held) measurement device 40*a*. The measurement device 40*a* is connected to the temperature sensors 24, 28, 28*, 30, 30*, and 32 by cables 44, or wirelessly communicate with the sensors temperature 24, 28, 28*, 30, 30*, and 32.

An air handler of a HVAC system 10*b* and including a measurement instrument or control device 40*b* mounted to an HVAC system 10*b* is shown in FIG. 6. The controller device 40*b* may be connected to the temperature sensors 24, 28, 28*, 30, 30*, and 32 by cables 44, or may wirelessly communicate with the temperature sensors 24, 28, 28*, 30, 30*, and 32, and is connected to the actuator 54 by the cable 44*b* to control the dampers 50 and 52 using a voltage signal. The measurement and controller device 40*b* preferably includes a low-voltage power supply or external power source, signal conditioner, microprocessor, wireless communication electronic technology 42*b*, and display 42*a* for receiving, processing, transmitting and displaying measurements from the temperature sensors 24, 28, 28*, 30, 30*, and 32.

The measurement device 40*b* may also provide low-voltage outputs to control the actuator A for controlling the position of outdoor air dampers 50 and return dampers 52. The measurement device 40*b* may also be wired or wireless and provide economizer damper position and Outdoor Air Fraction (OAF) measurements and operational Fault Detection Diagnostic (FDD) signals through a built-in display or external display through wireless communication signals to a building energy management system, standard thermostat, WIFI-enabled thermostat, internet connected computer, internet telephony system, or smart phone indicating maintenance requirements to check and correct outdoor air damper position, evaporator airflow and/or refrigerant charge of the air conditioning system.

Figure 14:
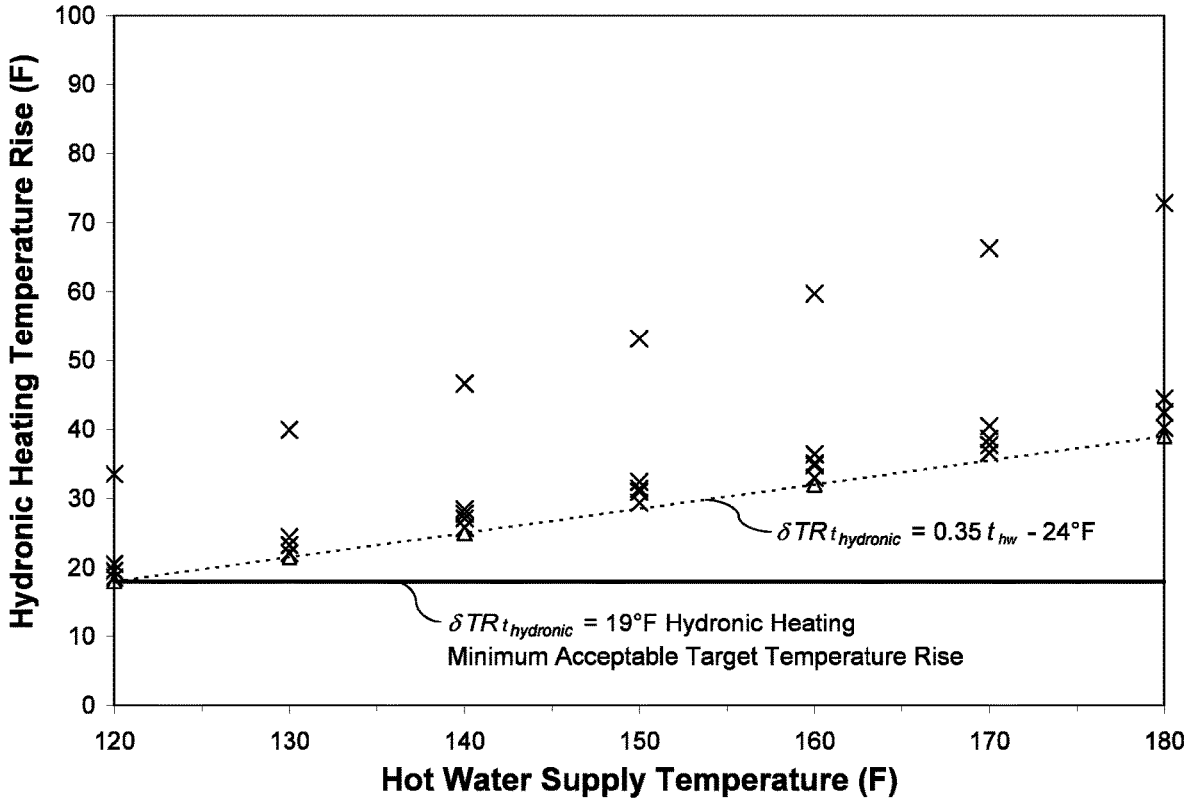
FIG. 14 shows a chart of hydronic heating coil manufacturer minimum acceptable temperature rise versus hot water temperature for 35 models.

FIG. 6 further shows an optional temperature sensor 37 which may be used to measure the inlet hot water supply 35 temperature for a hydronic heating system for calculating target temperature rise using the hydronic heating minimum acceptable target temperature rise equation shown in FIG. 14. Other than including the measurement and controller device 40*b* mounted to the HVAC system 10*b* and the optional temperature sensor 37 and the inlet hot water supply 35, the HVAC system 10*b* shares the features of the HVAC system 10*a* described in FIG. 5.

Figure 7:
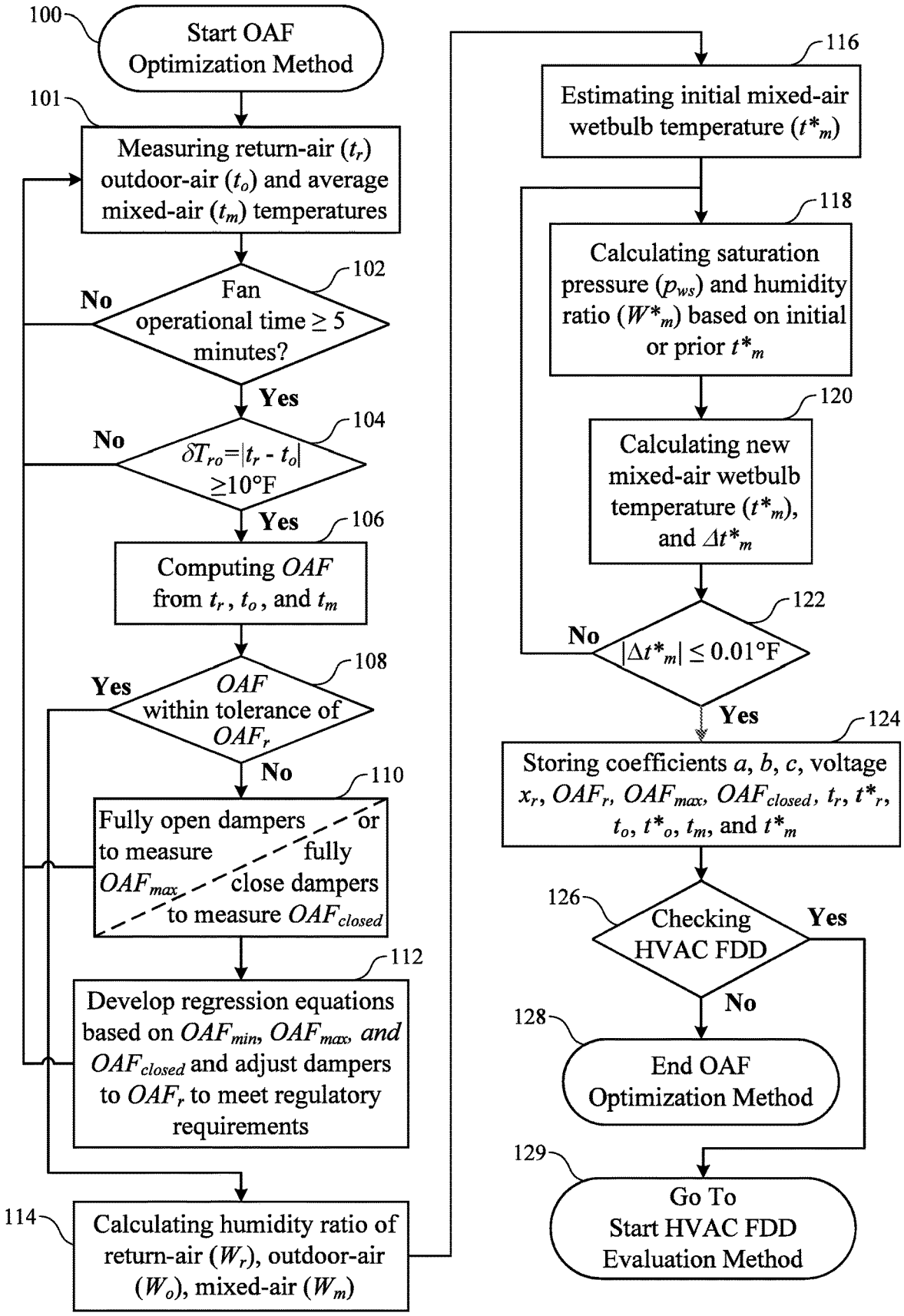
FIG. 7 shows a method for OAF optimization on an HVAC system while the HVAC system is operating, according to the present invention.

FIG. 7 shows a method for optimizing OAF on an HVAC system while the HVAC system is operating according to the present invention. The method includes starting the optimization at step 100, measuring return air temperature $t_r$ outdoor air temperature $t_o$, and mixed air temperature $t_m$ at step 101, and waiting for at least 5 minutes for sensors to measure air temperature at step 102. If the fan operational time is less than 5 minutes, then the method includes continuing to loop through step 101 to measure air temperatures until the fan has operated for at least 5 minutes according to step 102.

After 5 minutes of fan operational time, the method includes checking if the absolute value of the return-air minus outdoor-air temperature difference, $\delta T_{ro}$, is greater than a minimum temperature difference, preferably 10 degrees Fahrenheit, at step 104 according to the following equation.

$$\delta T_{ro} = |t_r - t_o| \geq 10 \qquad \text{Eq. 1}$$

Where, $\delta T_{ro}$=absolute value of the return-air minus outdoor-air drybulb temperatures (F), $t_r$=return-air drybulb temperature (F), and $t_o$=outdoor-air drybulb temperature (F).

If the absolute value of the return-air minus outdoor-air temperature difference is not greater than 10 degrees Fahrenheit, then the method loops back to step 100.

If the temperature difference is greater than 10 degrees Fahrenheit, then the method includes computing the Outdoor Air Fraction (OAF) from $t_r$, $t_o$ and $t_m$ at step 106 using the following equation.

$$OAF = \frac{t_r - t_m}{t_r - t_o} \qquad \text{Eq. 3}$$

Where, OAF=outdoor air fraction (dimensionless), $t_m$=mixed-air drybulb temperature (F).

The method may be implemented manually on units without a damper actuator. The method may be further implemented on units with an analog economizer controller with temperature sensors and low-voltage output signals to measure, adjust and correct the OAF using a damper actuator. The method may be further implemented on units with a digital economizer controller with microprocessor with FDD capabilities, temperature sensors and low-voltage output signals to control a damper actuator, and low-voltage output actuator control signals to measure, adjust and correct the OAF using a damper actuator and evaluate low airflow, low cooling capacity or low heating capacity. The controller may be able to take temperature measurements at specific initial, maximum, and closed economizer damper actuator control voltages, and use this information to calculate regression equation coefficients for the OAF versus economizer damper actuator voltage and with use the target minimum OAF based on regulatory requirements with the regression equation to solve for the optimal actuator voltage to achieve the target minimum OAF using the quadratic formula, and adjust the economizer dampers as necessary to achieve the optimally minimum OAF and then measure the OAF to verify the optimally minimum OAF is within an accepted tolerance of the minimum $OAF_r$ based on regulatory requirements for the building and occupancy. A preferred accepted tolerance is within plus or minus ten percent of the minimum $OAF_r$ based on regulatory requirements for the building and occupancy.

At step 108, the method includes checking the measured outdoor air fraction (OAF) to determine whether or not it is within ten percent of the minimum required outdoor air fraction ($OAF_r$) based on regulatory standards.

$$0.9 \times OAF_r \leq OAF \leq 1.1 \times OAF_r \qquad \text{Eq. 5}$$

At step 110, the method includes fully opening the economizer dampers and looping back to step 100 and measuring $t_r$, $t_o$ and $t_m$ at the maximum damper position and computing and storing the maximum Outdoor Air Fraction ($OAF_{max}$) based on $t_r$, $t_o$ and $t_m$ at step 106 using Equation 2. For an HVAC system with an economizer damper actuator, opening the dampers involves adjusting the damper actuator control voltage to the maximum voltage, typically 10V, and looping back to step 100 and measuring $t_r$, $t_o$ and $t_m$ at the maximum damper position and computing and storing the maximum Outdoor Air Fraction ($OAF_{max}$) based on $t_r$, $t_o$ and $t_m$ at step 106 using Equation 2.

Repeating step 110, the method includes fully closing the economizer dampers and looping back to step 100 and measuring $t_r$, $t_o$ and $t_m$ at the closed damper position and computing and storing the closed Outdoor Air Fraction ($OAF_{closed}$) based on $t_r$, $t_o$ and $t_m$ at step 106 using Equation 2. For an HVAC system with an economizer damper actuator, closing the dampers involves adjusting the damper actuator control voltage to the minimum voltage, typically 2V, and looping back to step 100 and measuring $t_r$, $t_o$ and $t_m$ at the closed damper position and computing and storing the closed Outdoor Air Fraction ($OAF_{closed}$) based on $t_r$, $t_o$ and $t_m$ at step 106 using Equation 2.

At step 112, the present invention method includes developing the regression equations used to adjust the damper position to the optimize Outdoor Air Fraction ($OAF_o$) to meet regulatory requirements per the following equations.

$$y_i = ax_i^2 + bx_i + c \qquad \text{Eq. 7}$$

Where, $y_i$=outdoor air fraction (OAF) based on economizer damper position (dimensionless), $x_i$=economizer damper position or control voltage varying from 2V closed to 10V fully open (Volts), a=regression coefficient, b=regression coefficient, and c=regression coefficient.

The regression equation coefficients are calculated using a least square method based on measuring OAF at the initial, maximum, and closed damper position at the economizer actuator control voltages for each damper position using the following matrix equations for the quadratic regression.

$$\underbrace{\begin{bmatrix} \sum x_i^4 & \sum x_i^3 & \sum x_i^2 \\ \sum x_i^3 & \sum x_i^2 & \sum x_i \\ \sum x_i^2 & \sum x_i & n \end{bmatrix}}_{X} \underbrace{\begin{bmatrix} a \\ b \\ c \end{bmatrix}}_{C} = \underbrace{\begin{bmatrix} \sum x_i^2 y_i \\ \sum x_i y_i \\ \sum y_i \end{bmatrix}}_{Y} \qquad \text{Eq. 9}$$

The method includes solving the above equation based on three OAF measurements at the initial, maximum, and closed damper positions by multiplying the inverse of the 3×3 matrix A times 1×3 matrix C to obtain the coefficients of the quadratic regression using the following equation.

$$C = X^{-1} Y \qquad \text{Eq. 11}$$

Where, $X^{-1}$=inverse of the 3×3 matrix X calculated according to the following equation, C=1×3 matrix C containing coefficients, a, b, and c of the quadratic regression equation, and Y=1×3 matrix Y noted in the above equation.

The method includes solving the inverse of the 3×3 matrix X using the following equations.

$$X = \begin{bmatrix} h & k & n \\ i & l & o \\ j & m & p \end{bmatrix} \qquad \text{Eg. 13}$$

$$X^{-1} = \frac{1}{detX} \begin{bmatrix} lb - om & nm - kp & ko - nl \\ oj - ip & hp - ni & ni - ho \\ im - lj & kj - hm & hl - ki \end{bmatrix} \qquad \text{Eq. 15}$$

$$\frac{1}{detX} = \frac{1}{hlp - imn + jko - hmo - jln - ikp} \qquad \text{Eq. 17}$$

Where, detX=determinant of matrix X which cannot equal zero. After calculating the 1×3 matrix C coefficients a, b, and c, using the above equations, the method includes calculating the position or control voltage, $x_r$, required for economizer dampers to achieve the required minimum $OAF_r$, to meet regulatory requirements using the following quadratic formula.

$$x_r = \frac{-b + \sqrt{b^2 - 4a(c - OAF_r)}}{2a} \qquad \text{Eq. 19}$$

Where, $OAF_r$=the required minimum $OAF_r$, to meet regulatory requirements, and $x_r$=the economizer actuator control voltage setting to achieve the required minimum $OAF_r$, to meet regulatory requirements.

After step 112, the present invention includes looping back to step 100 and measuring $t_r$, $t_o$, and $t_m$, computing final OAF in step 106, and checking whether or not the OAF is within acceptable tolerance of preferably ten percent of $OAF_r$ in step 108.

FIG. 9 provides a graph showing measurements of outdoor air fraction (OAF) versus economizer damper actuator position control voltage from closed to maximum open on an HVAC system according to the present invention. The economizer damper control voltage is determined using measurements of initial, maximum, and closed damper OAF and voltage. FIG. 10 illustrates how measurement data are used in a least squares method to determine coefficients of the quadratic regression Eq. 7. FIG. 10 provides a table of OAF measurements ($y_i$) based on damper actuator voltage ($x_i$). FIG. 10 shows measurement data entered into matrix X and matrix Y in Eq. 9. FIG. 10 shows the inverse matrix X is multiplied by matrix Y to calculate the matrix C quadratic regression coefficients in Eq. 11. FIG. 10 shows how the quadratic formula is used with the required minimum $OAF_r$ per regulatory requirements to calculate the required damper actuator control voltage $x_r$ in Eq. 19. The required damper actuator control voltage ($x_r$) is used to adjust the dampers, and the outdoor air fraction is measured per step 100 through step 106 of FIG. 7 to verify that the new OAF is preferably within an acceptable tolerance of the minimum allowable $OAF_r$ per regulatory requirements per step 108. Preferably, the optimization is performed when the difference between outdoor-air temperature and return-air temperature is at least 10 degrees Fahrenheit and more preferably at least 20 degrees Fahrenheit.

FIG. 11 illustrates the lookup table for calculating the target temperature split difference ($\delta T_t$) where the independent variables are the evaporator entering mixed-air drybulb temperature, $t_m$, and evaporator entering mixed-air wetbulb temperature, $t^*_m$, and the dependent variable is the target temperature split difference ($\delta T_t$).

The HVAC manufacturer protocols or regulatory standards require accurate measurement of mixed-air drybulb, $t_m$, and mixed-air wetbulb, $t^*_m$, entering the evaporator in order to lookup the required or target temperature difference across the evaporator (defined as the difference between mixed-air drybulb, $t_m$, minus supply-air drybulb, $t_s$, temperature) to diagnose and correct improper evaporator airflow or low cooling capacity. Low airflow can cause ice to form on the air filter and evaporator which blocks airflow and reduces cooling capacity and efficiency. Low cooling capacity can be caused by many faults including excess outdoor airflow, dirty or blocked air filters, blocked evaporator caused by dirt or ice buildup, blocked condenser coils caused by dirt or debris buildup, low refrigerant charge, high refrigerant charge, refrigerant restrictions, and non-condensable air or water vapor in the refrigerant system.

The HVAC manufacturer protocols or regulatory standards also require accurate measurement of mixed-air drybulb, $t_m$, and mixed-air wetbulb, $t^*_m$, entering the evaporator in order to lookup the required or target superheat (defined as the difference between refrigerant suction temperature and evaporator saturation temperature) in order to diagnose and correct refrigerant charge or other faults which can cause improper superheat outside published tolerances established by the manufacturer or regulatory agency. Superheat must be within published tolerances in order to maintain proper cooling capacity and efficiency and prevent liquid refrigerant from entering and damaging the refrigerant system compressor. Not having a method to accurately measure mixed-air drybulb, $t_m$, or wetbulb, $t^*_m$, will cause improper airflow and refrigerant system FDD as well as improper setup and operation of economizers and economizer FDD systems required by regulatory agencies.

Calculating the humidity ratios (lbm/lbm) of return-air $W_r$, outdoor-air, $W_o$ and mixed-air $W_m$ in step 114 are preferably performed using the following equations based on the Hyland Wexler formulas from the 2013 ASHRAE Handbook.

$$p1_{WS}=\mathrm{EXP}[C_1/t^*_r+C_2+C_3t^*_r+C_4t^{*2}_r+C_5t^{*3}_r+C_6\ln(t^*_r)] \quad \text{Eq. 21}$$

Where, $p1_{ws}$=saturation pressure at wetbulb temperature (psia) for the return air.

$t^*_r$=measured return air wetbulb temperature+459.67 (R)

$C_1$=−1.0440397 E+04, $C_2$=−1.1294650 E+01, $C_3$=−2.7022355 E−02, $C_4$=1.2890360 E−05, $C_5$=−2.4780681 E−09, $C_6$=6.5459673 E+00, and $$W^*_r = 0.621945\left[\frac{p1_{ws}}{p_a - p1_{ws}}\right] \quad \text{Eq. 23}$$

Where, $W^*_r$=humidity ratio corresponding to saturation at the return air wetbulb temperature, $t^*_r$ (lbm/lbm), $p_a$=ambient air pressure (psia), and $$W_r = \frac{(1093 - 0.556t^*_r)W^*_r - 0.24(t_r - t^*_r)}{(1093 + 0.444t_r - t^*_r)} \quad \text{Eq. 25}$$

Where, $W_r$=return air humidity ratio (lbm/lbm).

Computing humidity ratio of outdoor air $W_o$ (lbm/lbm) at step 114 is preferably performed using the following equations:

$$p2_{WS}=\mathrm{EXP}[C_1/t^*_o+C_2+C_3t^*_o+C_4t^{*2}_o+C_5t^{*3}_o+C_6\ln(t^*_o)] \quad \text{Eq. 27}$$

Where, $p2_{ws}$=saturation pressure at wetbulb temperature (psia) for the outdoor air, $t^*_o$=measured outdoor air wetbulb temperature +459.67 (R), and $$W^*_o = 0.621945\left[\frac{p2_{ws}}{pa - p2_{ws}}\right] \quad \text{Eq. 29}$$

Where, $W^*_o$=humidity ratio corresponding to saturation at the outdoor air wetbulb temperature, $t^*_o$ (lbm/lbm), and $$W_o = \frac{(1093 - 0.556t^*_o)W^*_o - 0.24(t_o - t^*_o)}{(1093 + 0.444t_o - t^*_o)} \quad \text{Eq. 31}$$

Where, $W_o$=outdoor air humidity ratio (lbm/lbm).

The method includes preferably calculating an initial value of the mixed-air humidity ratio $W_m$ from the $OAF_m$, $W_r$, and $W_o$ at step 114 using the following equation.

$$W_m=W_r-[W_r-W_o]\mathrm{OAF}_m \quad \text{Eq. 33}$$

Where, $W_m$=humidity ratio at the mixed-air conditions (lbm/lbm).

Estimating an initial value of mixed-air wetbulb temperature ($t^*_m$) at step 116 is preferably setting an initial value of mixed-air wetbulb temperature ($t^*_m$) to the mixed-air drybulb temperature minus 10 degrees Fahrenheit in cooling mode ($t^*_m=t_m-10$). Computing saturation pressure ($p_{ws}$) for the mixed-air wetbulb temperature ($t^*_m$) at step 118 is preferably performed using the initial or previous time-step estimate of the mixed-air wetbulb temperature, $t^*_m$, in the following equation.

$$p_{WS}=\mathrm{EXP}[C_1/t^*_m+C_2+C_3t^*_m+C_4t^{*3}_m+C_5t_6\ln(t^*_m)] \quad \text{Eq. 35}$$

Where, $p_{ws}$=saturation pressure at wetbulb temperature (psia)

$t^*_m$=mixed-air wetbulb temperature+459.67 (i.e., converted to degrees Rankine).

The method includes calculating the saturation humidity ratio ($W^*_m$) at step 118 from the saturation pressure ($p_{ws}$) using the following equation.

$$W^*_m = 0.621945\left[\frac{p_{ws}}{pa - p_{ws}}\right] \quad \text{Eq. 37}$$

Where, $W^*_m$=humidity ratio at the mixed-air saturation pressure ($p_{ws}$) (lbm/lbm).

The method includes calculating a new estimate of mixed-air wetbulb temperature ($t^*_m$) at step 120, preferably performed using the following equation including the previous step mixed-air wetbulb temperature ($t^*_{m_{i-1}}$) estimate.

$$t^*_m = 0.5\left[t^*_{m_{i-1}} + \frac{1093W_m + 0.444W_mt_m - 1093W^*_m + 0.24t_m}{W_m - 0.556W^*_m + 0.24}\right] \quad \text{Eq. 39}$$

Where $t^*_m$=new estimate of mixed-air wetbulb temperature (F), and $t^*_{m_{i-1}}$=previous step mixed-air wetbulb temperature (F).

The new estimate of mixed-air wetbulb temperature is tested for convergence at step 122, to evaluate whether or not the absolute value of the change in $\Delta t^*_m$ is less than or equal to 0.01 degrees Fahrenheit using the following equation.

$$|\Delta t^*_m| \leq 0.01 \quad \text{Eq. 41}$$

If the absolute value of the change in $\Delta t^*_m$ is less then or equal to 0.01 degrees Fahrenheit, then the method includes proceeding to step 124 to check whether or not the unit is operating in cooling mode. If step 124 determines that the absolute value of the change $\Delta t^*_m$ is not less than or equal to 0.01 degrees Fahrenheit, then steps 118, 120, and 122 are preferably repeated calculating $p_{ws}$ and $W^*_s$ a new estimate of $t^*_m$ until the absolute value of the recursive change in wetbulb temperature $\Delta t^*_m$ is less than or equal to 0.1 degrees Fahrenheit.

At step 124 the method includes storing coefficients a, b, and c, and the economizer actuator control voltage, $x_r$, to meet the minimum outdoor air fraction, $OAF_r$, to meet regulatory requirements, maximum $OAF_{max}$, closed $OAF_{closed}$, mixed-air drybulb temperature $t_m$, mixed-air wetbulb temperature, $t^*_m$, and return and outdoor air drybulb and wetbulb temperature measurements, $t_r$, $t^*_r$, $t_o$, and $t^*_o$, and proceeding to step 126.

Figure 8:
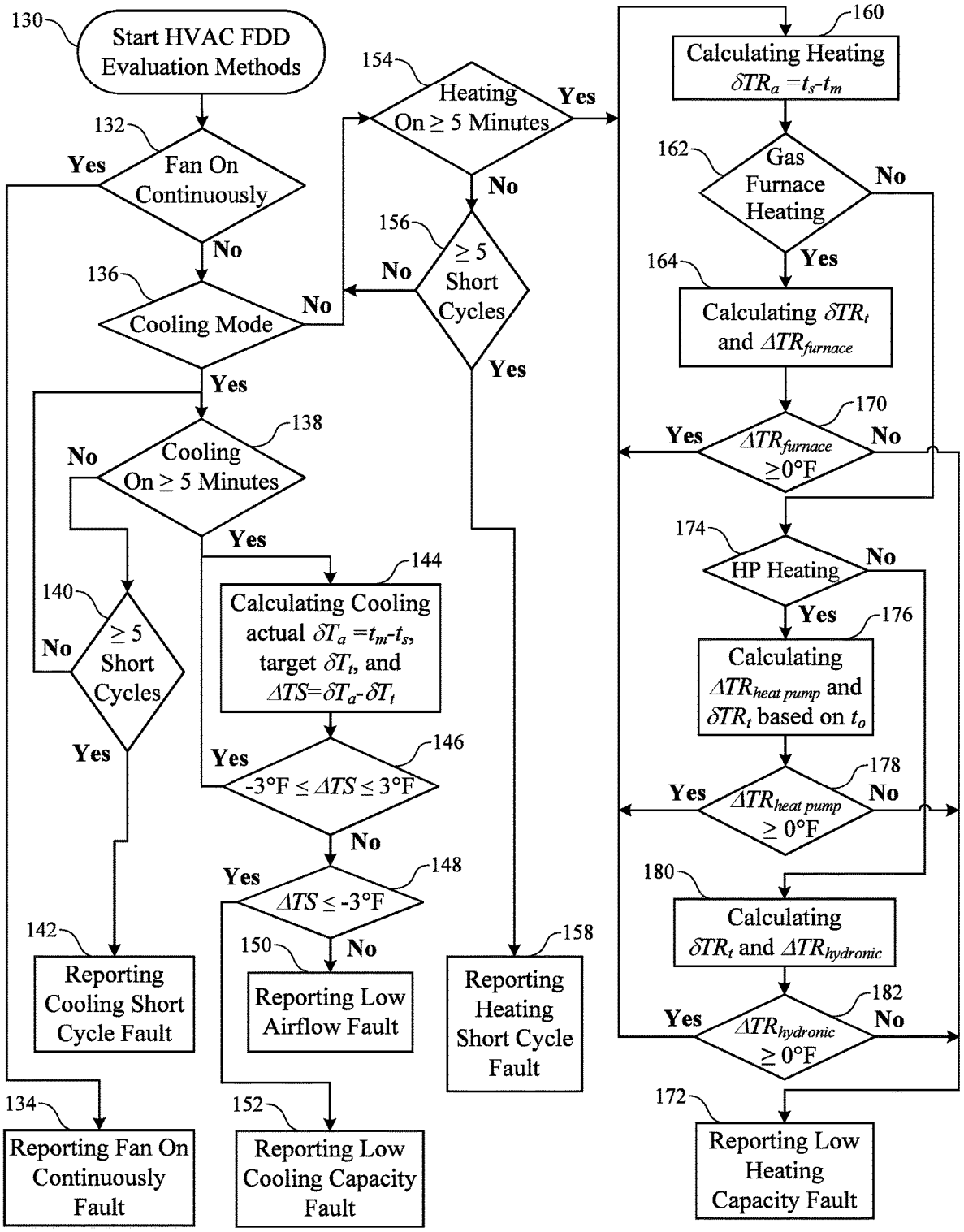
FIG. 8 shows a method for Fault Detection Diagnostic (FDD) evaluation on an HVAC system while the HVAC system is operating, according to the present invention.

At step 126, the method includes checking whether or not to evaluate HVAC FDD, and if not, ending the OAF optimization method at step 128, or going to step 129 and proceeding to step 131 and starting the HVAC FDD evaluation method shown in FIG. 8.

FIG. 8 shows a method for performing a FDD evaluation on an HVAC system while the HVAC system is operating according to the present invention. The method starts at step 130 and includes first checking whether or not the ventilation fan has been operating continuously at Step 132 based on continuous fan operation greater than a maximum fan run time, $FT_{max}$, for example 24 hours, or continuous fan operation with no heat source or cool source on, followed by a heat or cool source operational time, and followed by continuous fan operation with no heat source or cool source on. If the fan has been operating continuously, then the method includes reporting a fan on continuously fault at step 134.

If the fan has not been operating continuously, then the method proceeds to Step 136 and checking whether or not the HVAC system is in cooling or heating mode. If in cooling mode, the method includes detecting and diagnosing low airflow and low cooling capacity faults in steps 138 through 158. In some embodiments in cooling mode, the method includes performing FDD of refrigerant superheat based on $t^*_m$ and $t_o$ in steps 138 through 158. If in heating mode, the method includes steps for detecting and diagnosing low heating capacity faults in steps 154 through 182.

At step 138, the method includes checking if the cooling system has been operating for at least a minimum cooling run time, preferably five minutes, and if not, then the method includes checking short cycle cooling operation for five successive cycles (i.e., failing the test of step 138 five consecutive times) at Step 140, and if yes, then generating a FDD alarm signal reporting a cooling short cycle fault at Step 142.

After the minimum fan run time of cooling system operation at Step 144, the method includes calculating the actual temperature split difference ($\delta T_a$) based on the mixed-air drybulb temperature ($t_m$) minus the supply-air temperature ($t_s$) according to the following equation.

$$\delta T_a = t_m - t_s \quad \text{Eq. 43}$$

At step 144, the method also includes calculating the target temperature split difference ($\delta T_t$) across the cooling system evaporator and the temperature split difference ΔTS defined as the actual temperature split minus the target temperature split. The method includes calculating the target temperature split difference ($\delta T_t$) using a target temperature split lookup table shown in FIG. 11, where the independent variables are the evaporator entering mixed-air drybulb temperature, $t_m$, and evaporator entering mixed-air wetbulb temperature, $t^*_m$. The method also includes calculating the target temperature split difference ($\delta T_t$) using the following equation.

$$\delta T_t = C_7 + C_8 t_m + C_9 t_m^2 + C_{10} t^*_m + C_{11} t^{*}_m{}^2 + C_{12} (t_m \times t^*_m) \quad \text{Eq. 45}$$

Where, $\delta T_t$=target temperature difference between mixed-air and supply-air in cooling mode (F), $t_m$=measured mixed-air drybulb temperature (F), $t^*_m$=mixed-air wetbulb temperature (F), $C_7$=−6.509848526 (F), $C_8$=−0.942072257 ($F^{-1}$), $C_9$=0.009925115 ($F^{-2}$), $C_{10}$=1.944471104 ($F^{-1}$), $C_{11}$=−0.0208034037991888 ($F^{-2}$)

$C_{12}$=−0.000114841 ($F^{-2}$)

At step 144, the method also includes calculating the delta temperature split difference (ΔTS) based on the actual temperature split difference ($\delta T_a$) minus the target temperature split difference ($\delta T_t$) using the following equation.

$$\Delta TS = \delta T_a - \delta T_t \quad \text{Eq. 47}$$

Where, ΔTS=delta temperature split difference between actual temperature split and target temperature split (F).

At step 146 the method checks whether or not the temperature split difference ΔTS is within plus or minus a temperature split threshold, preferably ±3 degrees Fahrenheit (or a user input value). If ΔTS is within plus or minus the temperature split threshold (or the user input value), then the cooling system is within tolerances, no FDD alarm signals are generated, and the method loops back to continue checking proper operation of the cooling system by repeating steps 144 and 146.

At step 148, the method checks whether or not the temperature split difference (ΔTS) is less than a negative minimum temperature split difference threshold, preferably less than −3 degrees Fahrenheit (or a user input value). If the method determines the temperature split difference (ΔTS) is less than the negative minimum temperature split difference threshold (or the user input value), then the method includes providing a FDD alarm signal reporting a low cooling capacity fault at step 152 to check for low cooling capacity which can be caused by many faults including excess outdoor airflow, dirty or blocked air filters, blocked evaporator caused by dirt or ice buildup, blocked condenser coils caused by dirt or debris buildup, low refrigerant charge, high refrigerant charge, refrigerant restrictions, or non-condensable air or water vapor in the refrigerant system.

At step 148, if the method determines that the temperature split difference (ΔTS) is not greater than the negative minimum temperature split difference threshold, then the method includes providing a FDD alarm signal at step 150 reporting a low airflow fault to check for low airflow which can cause ice to form on the air filter and evaporator which blocks airflow and severely reduces cooling capacity and efficiency.

At step 136 if the method determines the system is in heating mode, then the method includes proceeding to step 154.

At step 154, the method includes checking if the heating system has been operating for greater then a minimum heater run time, preferably five minutes, and if no, then the method includes checking short cycle heating operation for 5 successive cycles at Step 156, and if yes, then generating a FDD alarm signal reporting a heating short cycle fault at Step 158.

After at least the minimum heater run time of heating system operation at Step 160, the method includes calculating the actual temperature rise ($\delta TR_a$) for heating based on the supply-air temperature minus the mixed-air temperature according to the following equation.

$$\delta TR_a = t_s = t_m \quad \text{Eq. 49}$$

At step 162, the method includes checking whether or not the heating system is a gas furnace, and if the method determines the heating system is a gas furnace, then the method proceeds to step 164.

Figure 12:
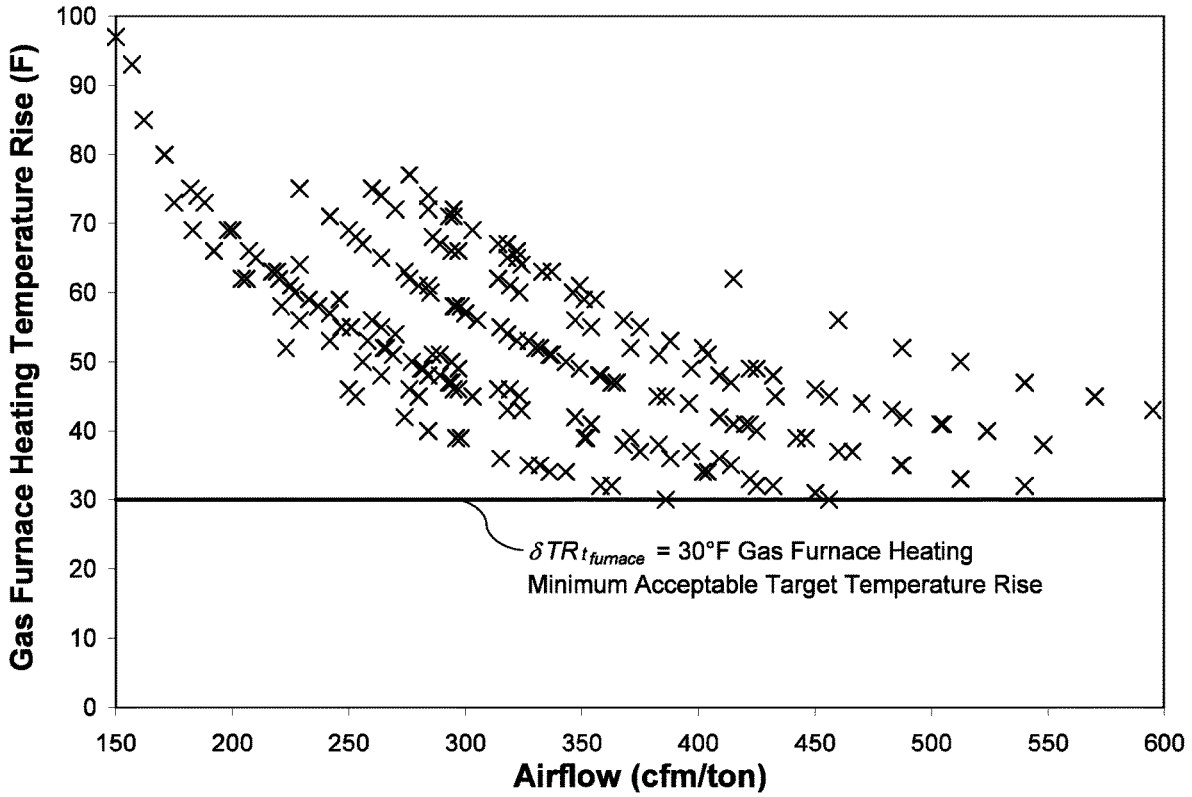
FIG. 12 shows a chart of gas furnace manufacturer minimum acceptable temperature rise data versus airflow for 253 models.

At step 164, the method includes calculating the minimum acceptable target supply-air temperature rise for a gas furnace which is preferably a function of airflow and heating capacity based on furnace manufacturer temperature rise data shown in FIG. 12, and is preferably 30 degrees Fahrenheit as shown in the following equation.

$$\delta TR_{t_{furnace}} = 30 \quad \text{Eq. 51}$$

Where, $\delta TR_{t_{furnace}}$=minimum acceptable furnace temperature rise. The minimum acceptable furnace temperature rise may vary from 30 to 100 degrees Fahrenheit or more depending on make and model, furnace heating capacity, airflow, and return temperature.

At step 164, the method also includes calculating the delta temperature rise for the gas furnace heating system, $\Delta TR_{furnace}$, according to the following equation.

$$\Delta TR_{furnace} = \delta T_a - \delta TR_{t_{furnace}} \quad \text{Eq. 53}$$

At step 170 the method includes calculating whether or not the delta temperature rise for the furnace is greater than or equal to zero degrees Fahrenheit according to the following equation.

$$\Delta TR_{furnace} = \delta T_a - \delta TR_{t_{furnace}} \geq 0 \quad \text{Eq. 55}$$

At step 170, if the method determines the delta temperature rise for the furnace is greater than or equal to zero degrees Fahrenheit, then the gas furnace heating system is considered to be within tolerances, no FDD alarm signals are generated, and the method includes a loop to continue checking the temperature rise while the furnace heating system is operational using steps 160 through 170.

At step 170, if the method determines the delta temperature rise for the furnace is less than zero degrees Fahrenheit, then proceeds to step 172.

At step 172, for a gas furnace heating system, the method includes preferably providing at least one FDD alarm signal reporting a low heating capacity fault which can be caused by excess outdoor airflow, improper damper position, improper economizer operation, dirty or blocked air filters, low blower speed, blocked heat exchanger caused by dirt buildup, loose wire connections, improper gas pressure or valve setting, sticking gas valve, bad switch or flame sensor, ignition failure, misaligned spark electrodes, open rollout, open limit switch, limit switch cycling burners, false flame sensor, cracked heat exchanger, combustion vent restriction, improper orifice or burner alignment, or non-functional furnace.

At step 162, the method includes checking whether or not the heating system is a gas furnace, and if the method determines the heating system is not a gas furnace, then the method proceeds to step 170.

At step 174, the method includes checking whether or not the heating system is a heat pump, and if the method determines the heating system is a heat pump, then the method proceeds to step 176.

Figure 13:
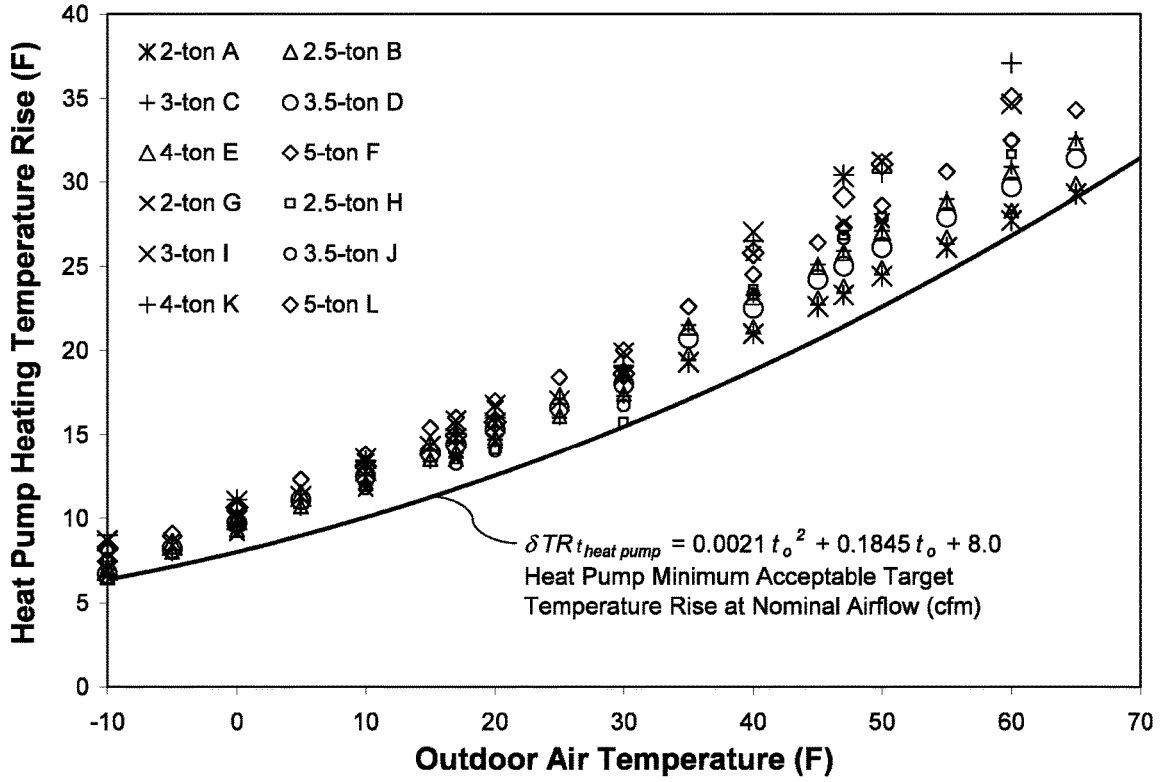
FIG. 13 shows a chart of heat pump manufacturer minimum acceptable temperature rise data versus outdoor air temperature for 12 different models.

At step 176, the method includes measuring the target temperature rise for heat pump heating based on the minimum acceptable target temperature rise which is preferably a function of outdoor air temperature as shown in the following equation based on heat pump manufacturer minimum acceptable temperature rise data shown in FIG. 13.

$$\delta TR_{t_{heat\ pump}} = [C_{21}\, t_o^2 + C_{22} t_o + C_{23}] \quad \text{Eq. 57}$$

Where, $\delta TR_{t_{heat\ pump}}$=minimum acceptable heat pump temperature rise, $C_{21}$=0.0021 ($F^{-1}$), $C_{22}$=1.845 (dimensionless), and $C_{23}$=8.0 (F).

Temperature rise coefficients may vary depending on user input, heat pump make and model, heat pump heating capacity, airflow, outdoor air temperature, and return temperature. Minimum temperature rise coefficients for a heat pump are based on outdoor air temperatures ranging from −10 F to 65 Fahrenheit, airflow from 300 to 400 cfm/ton, and return temperatures from 60 to 80 degrees Fahrenheit.

At step 176, the method also includes calculating the delta temperature rise for the heat pump heating system according to the following equation.

$$\Delta TR_{heat\ pump} = \delta T_a - \delta TR_{t_{heat\ pump}} \quad \text{Eq. 58}$$

At step 178, the method includes calculating whether or not the delta temperature rise for the heat pump heating system is greater than or equal to zero degrees Fahrenheit according to the following equation.

$$\Delta TR_{heat\ pump} = \delta T_a - \delta TR_{t_{heat\ pump}} \leq 0 \quad \text{Eq. 59}$$

At step 178, if the method determines the delta temperature rise for the heat pump is greater than or equal to zero degrees Fahrenheit, then the heat pump heating system is considered to be within tolerances, no FDD alarm signals are generated, and the method includes a loop to continue checking the temperature rise while the heat pump heating system is operational using steps 160 through 178.

At step 178, if the method determines the delta temperature rise for the heat pump is less than zero degrees Fahrenheit, then the method proceeds to step 172.

At step 172, for a heat pump heating system, the method includes preferably providing at least one FDD alarm signal reporting a low heating capacity fault to check the system for low heating capacity which can be caused by many faults including excess outdoor airflow, improper damper position, improper economizer operation, dirty or blocked air filters, blocked heat pump indoor coil caused by dirt buildup, improper thermostat setup or malfunction, loose wire connections, blocked outdoor coil caused by ice, dirt or debris, defective capacitor or relay, failed outdoor coil fan motor or capacitor, failed reversing valve or improper reversing valve control, improper refrigerant charge, refrigerant restriction (filter drier or expansion device), non-condensable air or water vapor in system, malfunctioning defrost controller, high airflow above 450 cfm/ton, failing compressor (locked rotor, leaking valves, etc.), or non-functional heat pump.

At step 174, if the method determines the heating system is not a heat pump, then the method proceeds to step 180.

At step 180, the method measures the target temperature rise for the hydronic heating system based on the minimum acceptable target supply-air temperature rise according to the following equation which is preferably a function of hot water supply temperature and may vary from 18 to 73 degrees Fahrenheit depending on airflow, coil heating capacity, and hot water supply temperature, $t_{hw}$, as shown in FIG. 14.

$$\delta TR_{t_{hydronic}}=[C_{25}\, t_{hw}+C_{26}] \quad \text{Eq. 61}$$

Where, $\delta TR_{t_{hydronic}}$=minimum acceptable hydronic temperature rise, $C_{25}$=0.35 ($F^{-1}$), and $C_{26}$=−24 (F).

The method also includes the following simplified equation to measure the target temperature rise for the hydronic heating system for all systems regardless of hot water supply temperature as shown in FIG. 14.

$$\delta TR_{t_{hydronic}}=C_{27} \quad \text{Eq. 62}$$

Where, $\delta TR_{t_{hydronic}}$=minimum acceptable hydronic temperature rise, $C_{27}$=19 degrees Fahrenheit (F).

At step 180, the method also includes calculating the delta temperature rise for the hydronic heating system according to the following equation.

$$\delta TR_{hydronic}=\delta T_a-\delta TR_{t_{hydronic}} \quad \text{Eq. 63}$$

At step 182, the method includes calculating whether or not the delta temperature rise for the hydronic heating systems greater than or equal to zero degrees Fahrenheit according to the following equation.

$$\Delta TR_{hydronic}=\delta T_a-\delta TR_{t_{hydronic}}\geq 0 \quad \text{Eq. 65}$$

At step 182, if the method determines the delta temperature rise for the hydronic heating system is greater than or equal to zero degrees Fahrenheit, then the hydronic heating system is considered to be within tolerances, no FDD alarm signals are generated, and the method includes a loop to continue checking the temperature rise while the hydronic heating system is operational using steps 160 through 182.

At step 182, if the method determines the delta temperature rise for the hydronic heating system is less than zero degrees Fahrenheit, then the method proceeds to step 172.

At step 172, for a hydronic heating system, the method includes preferably providing at least one FDD alarm signal reporting a low heating capacity fault to check the system for low heating capacity which can be caused by many faults including excess outdoor airflow, improper damper position, improper economizer operation, dirty or blocked air filters, blocked hydronic coil caused by dirt buildup, improper thermostat setup or malfunction, loose wire connections, failed or stuck hydronic control valve, defective capacitor or relay, low hot water temperature setting, failed water heater or boiler, leak or loss of hydronic fluid, failed capacitor, high airflow above 450 cfm/ton, air in hydronic system, or non-functional hydronic circulation controller or pump.

Figure 15:
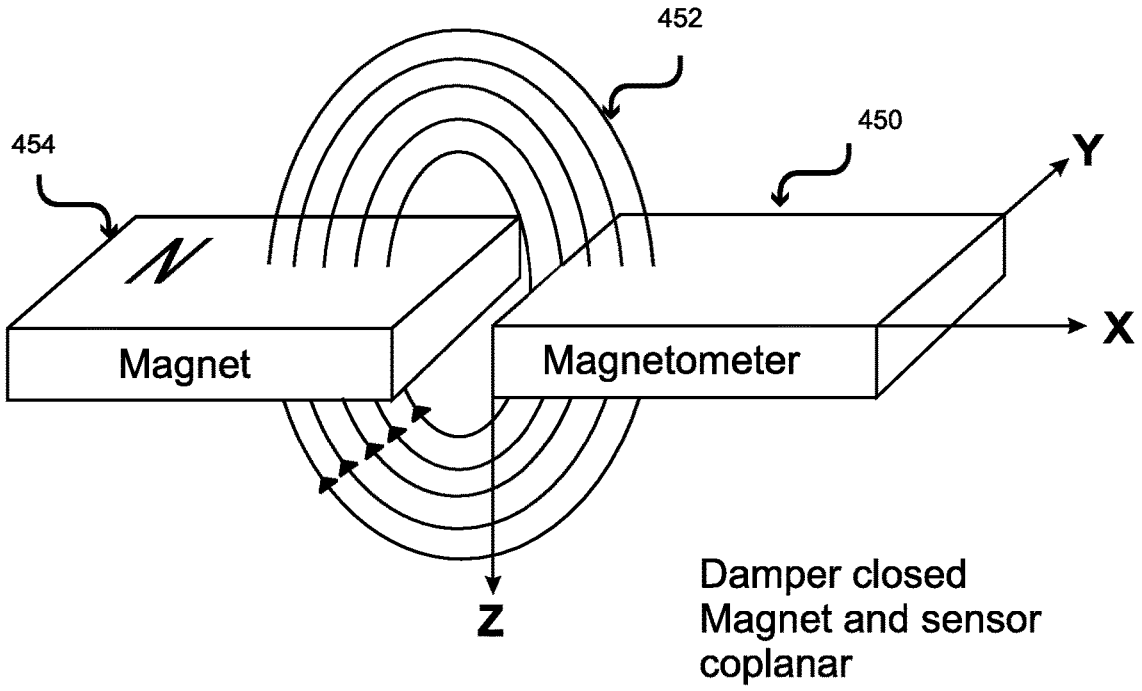
FIG. 15 shows a magnetometer co-planar with a magnet according to the present invention.

FIG. 15 shows a magnetometer 450 co-planar with a magnet 454. The magnetic field generated by the magnet is in the Z plane of the 3-dimensional MEMS magnetometer.

Figure 16:
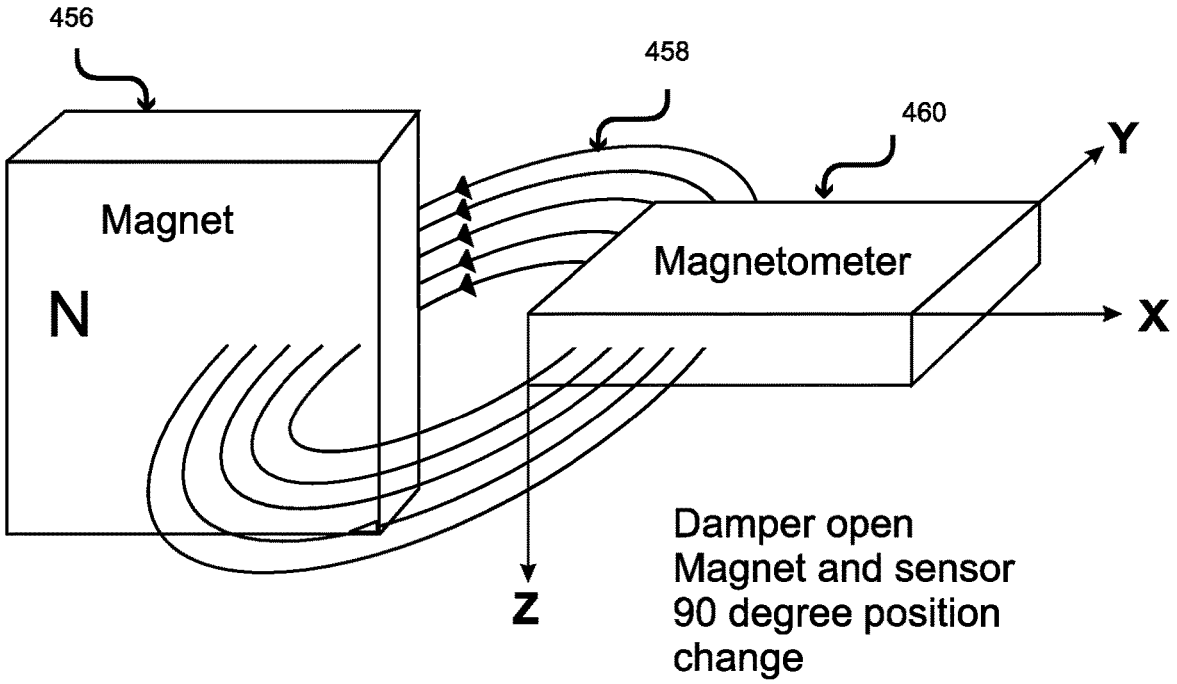
FIG. 16 shows the magnet according to the present invention rotated 90 degrees.

FIG. 16 shows the magnet 456 rotated 90 degrees from FIG. 47. The magnetic field is now in the Y plane of the 3-dimensional MEMS magnetometer.

Figure 17:
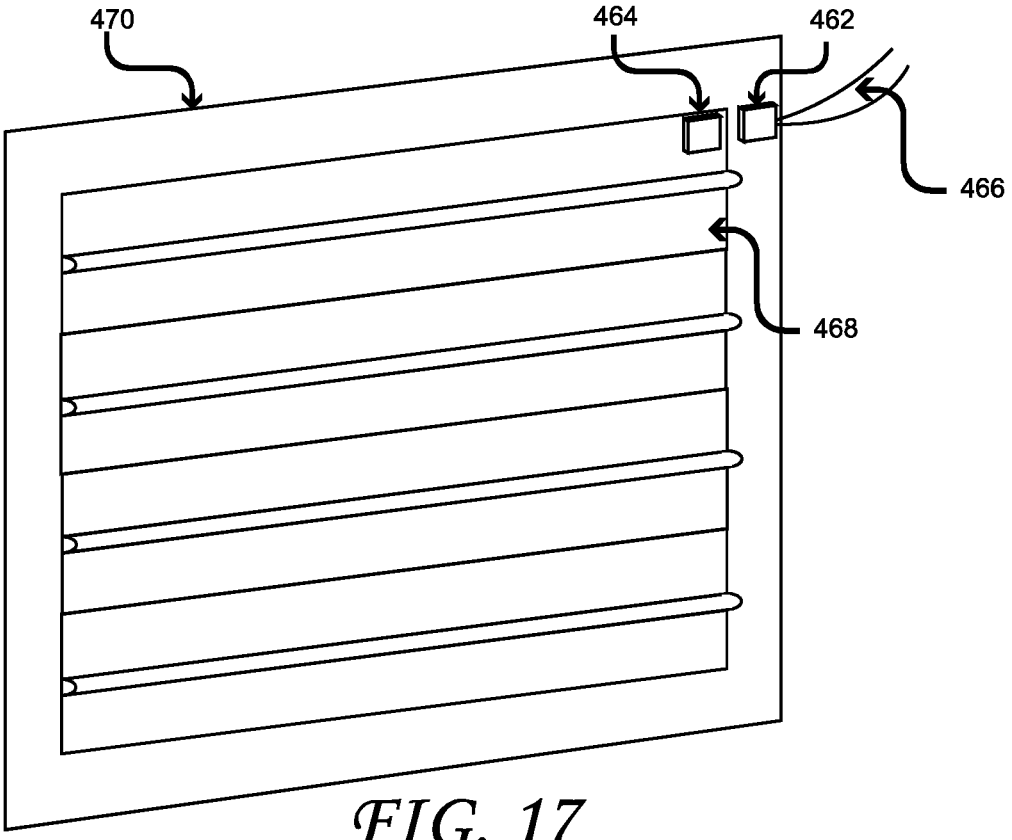
FIG. 17 shows an economizer frame and damper assembly with a magnet mounted to one of the economizer movable dampers according to the present invention in the vertical position (closed).

FIG. 17 shows an economizer frame and damper assembly 470 with a magnet 464 mounted to one of the economizer dampers 468 in the vertical position (closed). The magnetometer 462 is mounted to the stationary frame of the economizer 470. Wires to allow communication between the present invention and the magnetometer are shown 466.

Figure 18:
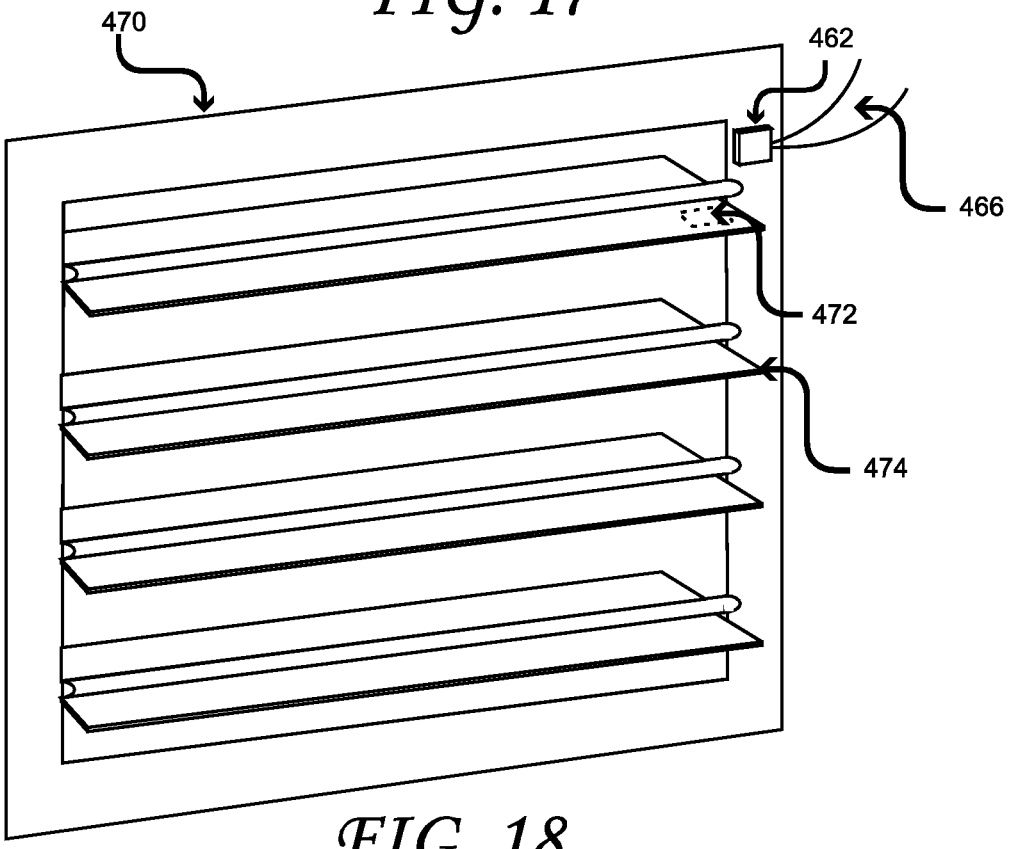
FIG. 18 shows the economizer frame and damper assembly with a magnet outline mounted to one of the economizer dampers in the horizontal position (open) according to the present invention.

FIG. 18 shows the economizer frame and damper assembly 470 with a magnet outline 472 mounted to one of the economizer dampers 474 in the horizontal position (open). The magnet 464 is on the opposite side of the damper and therefore shown in outline.

Figure 19:
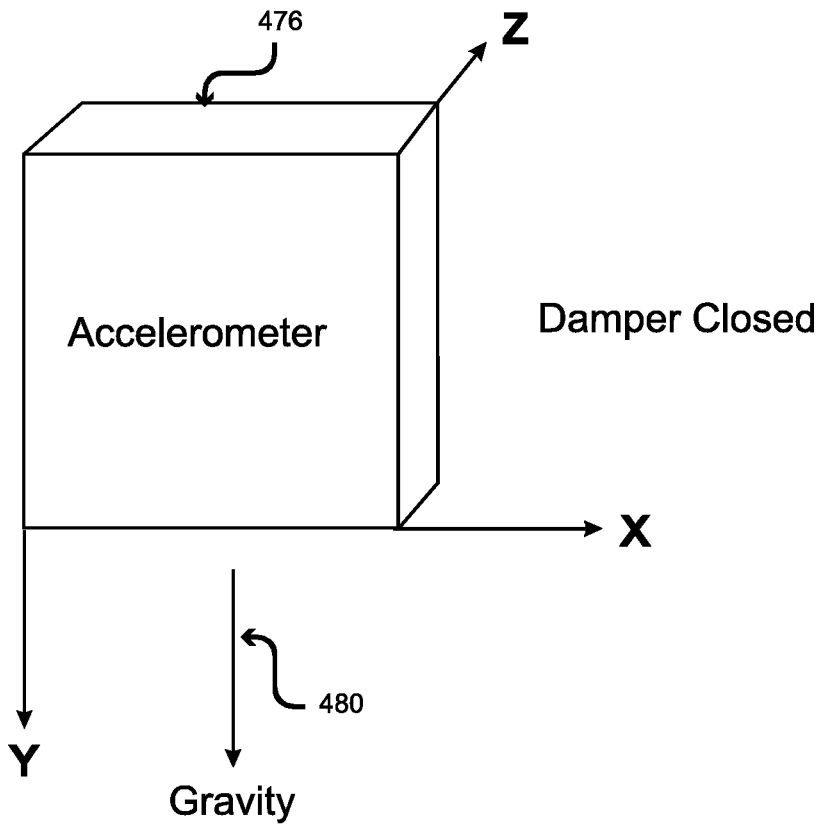
FIG. 19 shows the outline of an accelerometer or an IMU MEMS device mounted to a movable damper with the damper closed (where damper is not shown) according to the present invention.

FIG.19 shows the outline of an accelerometer 476 in a vertical position. This is the position the accelerometer would be mounted on an economizer damper when closed. The gravitational acceleration vector 480 is pointing down towards the earth. The value of the acceleration due to gravity is 9.81 m/s2 and is always constant. The gravitational acceleration vector is shown in the Y axis of the 3-dimensional MEMS accelerometer.

Figure 20:
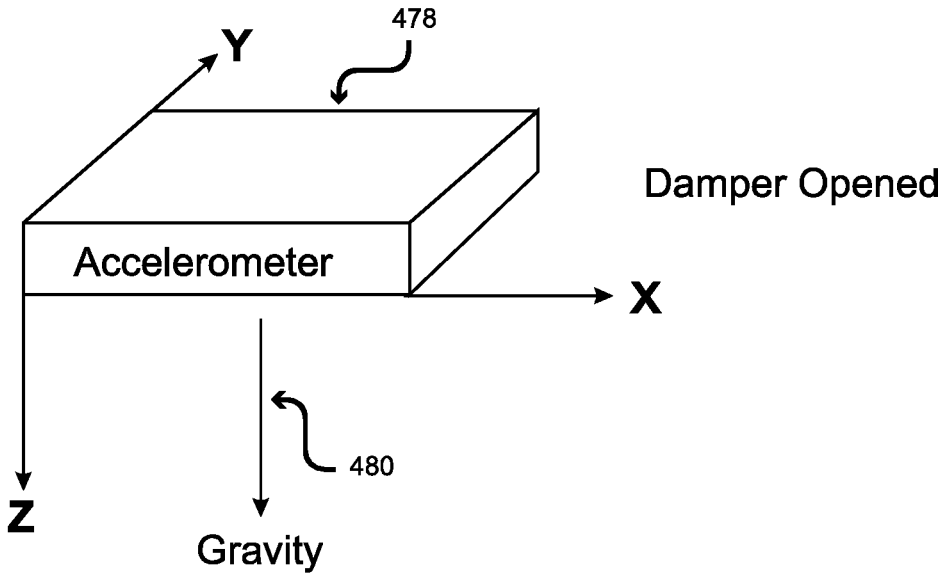
FIG. 20 shows the accelerometer and the IMU MEMS device mounted to a movable damper with the damper rotated open to the horizontal position (where damper is not shown) according to the present invention.

FIG. 20 shown the accelerometer 478 rotated to the horizontal position. This is the position the accelerometer would be driven to on an economizer with the dampers open. The gravitational vector is not in the Z plane of the 3-dimensional MEMS accelerometer.

Figure 21:
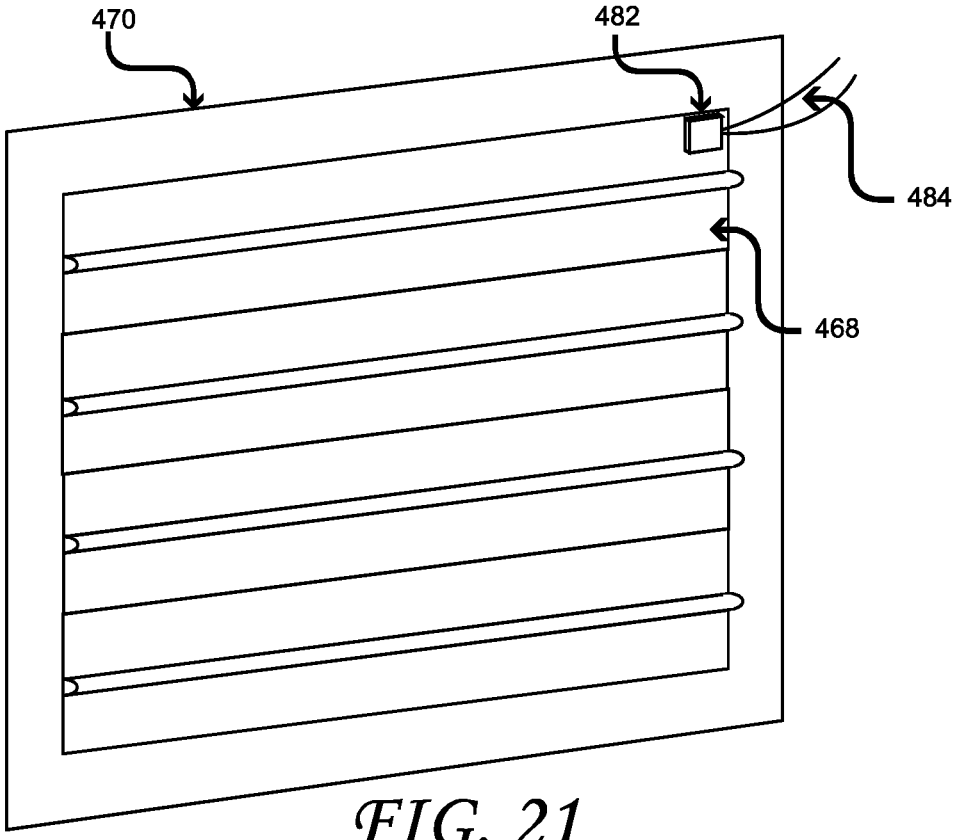
FIG. 21 shows an accelerometer or IMU MEMS device mounted on a movable economizer damper with the damper closed according to the present invention.

FIG. 21 shows an accelerometer 482 mounted on an economizer 470 with a closed economizer damper 468. Wires to allow communication between the present invention and the accelerometer are shown 484. The accelerometer is in the vertical orientation.

Figure 22:
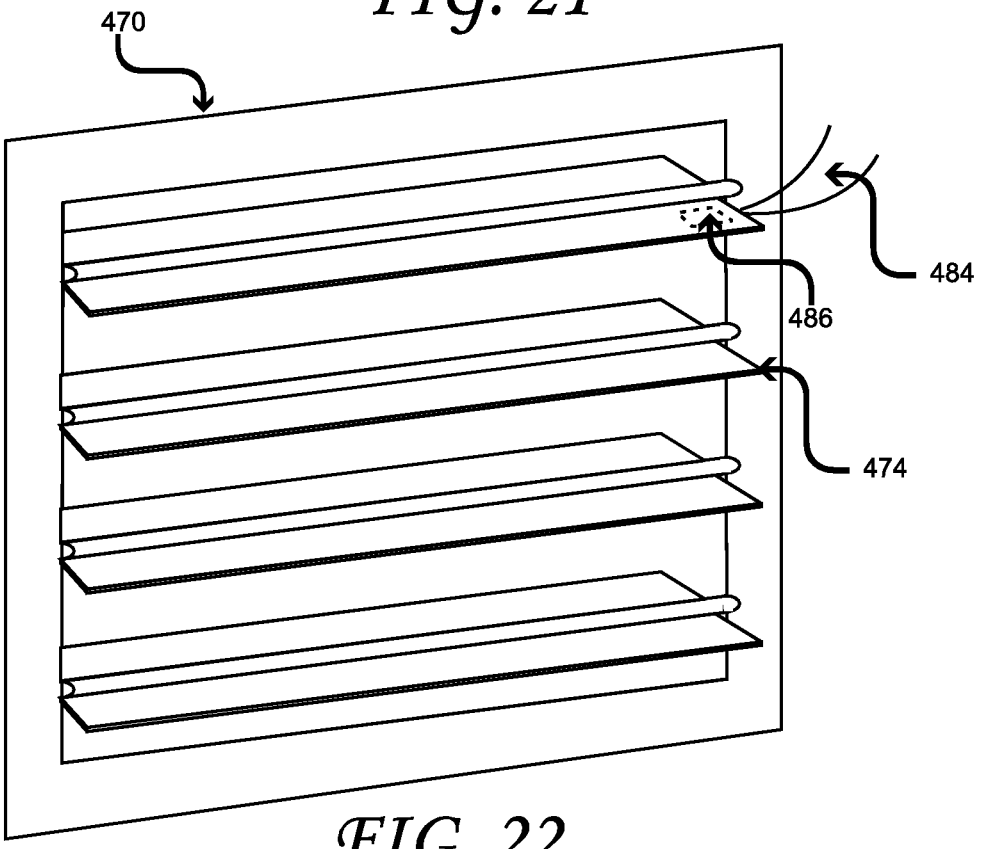
FIG. 22 shows an outline of a hidden accelerometer or IMU MEMS device mounted on a movable economizer damper with the damper open according to the present invention.

FIG. 22 shows an outline 486 of the hidden accelerometer mounted on an economizer 470 with an open economizer damper 474. Wires to allow communication between the present invention and the accelerometer are shown 484. The accelerometer is driven to the horizontal orientation by the economizer actuator opening the economizer dampers.

Figure 23:
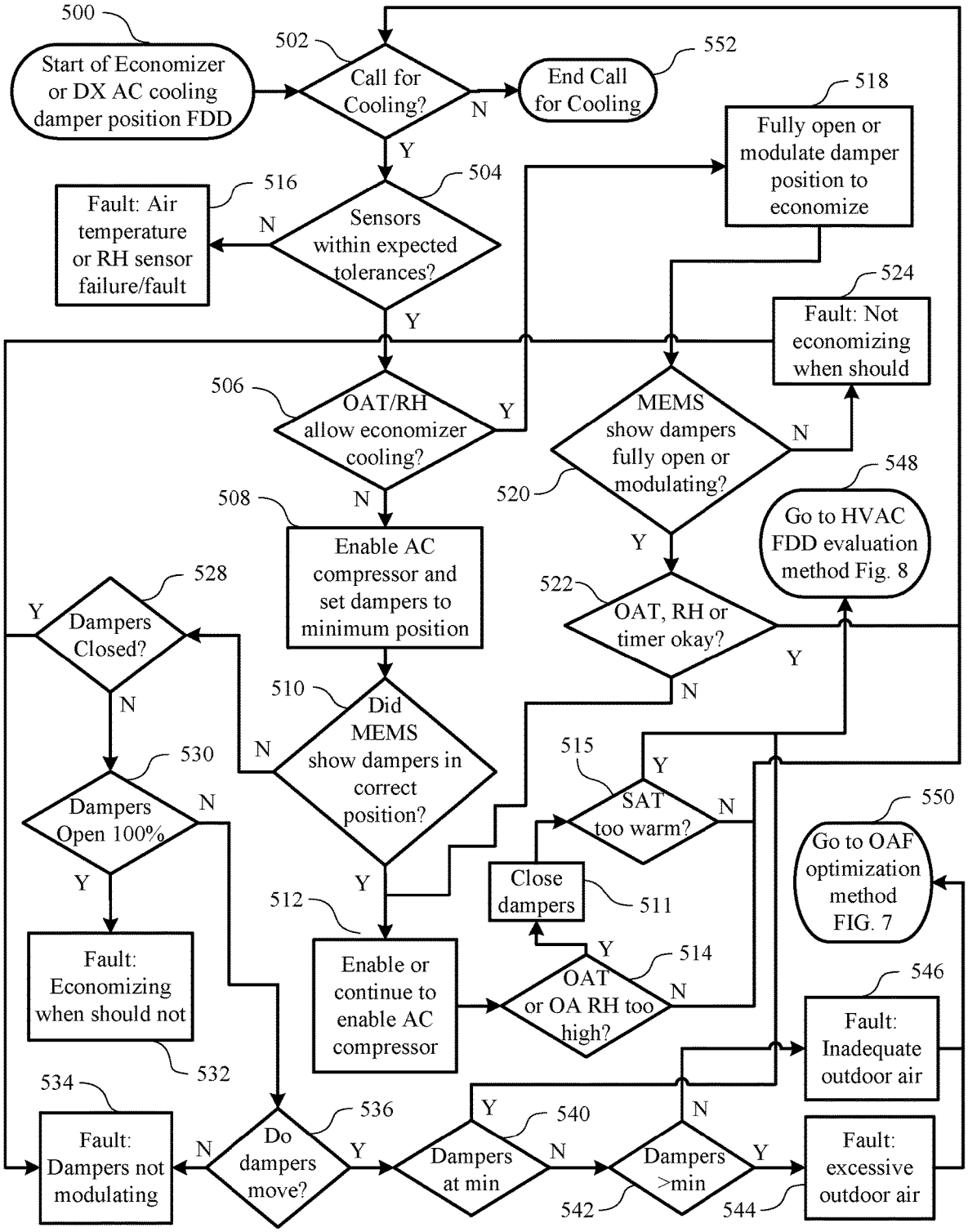
FIG. 23 shows a flow chart for detecting and diagnosing economizer faults during a call for cooling using a MEMS device to measure the physical position of the dampers as well as air temperature and relative humidity sensors according to the present invention.

FIG. 23 shows the cooling economizer damper position FDD method using a MEMS sensor device such as a magnetometer, an accelerometer, an IMU or a rotatiometer to measure the physical position of the dampers and determine if there is a fault with the economizer damper positioning mechanism. The fault detection process involves positioning the dampers to a fully closed position and the MEMS device is sampled to store this angular position. The dampers are then moved to a fully open position and the MEMS sensor is sampled again and the value is stored. As the dampers modulate between the fully closed position and fully open position, the MEMS device returns an angular value and the physical position of the dampers can be calculated. Step 500 is the start of the Cooling Economizer Damper Position FDD method. Step 500 is the Start of Economizer or DX AC cooling damper position FDD. In step 502, the economizer monitors the signals from the thermostat to determine if there is a call for cooling. If there is no call for cooling, the FDD method proceeds to Step 552 End Call for Cooling. If there is call for cooling, the method proceeds to step 504. In step 504, the economizer monitors the temperature or relative humidity sensors and the MEMS device to determine if values returned from these elements are within the normal tolerances. For instance, if any temperature or RH sensors are an open circuit or a short, the economizer will proceed to step 516 and signal an "Fault: Air Temperature or RH Sensor Failure/Fault." If all sensors are within expected tolerances, then the method proceeds to step 506.

In step 504, the method determines whether or not an air temperature sensor is failed or faulted based on measuring at least one signal selected from the group consisting of: a floating signal, a grounded signal and a temperature measurement outside of a tolerance range selected from the group consisting of: OAT less than −50° F. or greater than +140° F., RAT less than 50° F. or greater than 120° F., MAT less than −50° F. or greater than +140° F., SAT for cooling less than 33° F. or greater than 120° F. and SAT for heating less than 65° F. or greater than 140° F. At step 504, the method can also determine whether or not a relative humidity sensor is failed or faulted based on measuring at least one signal selected from the group consisting of: a floating signal, a grounded signal and a relative humidity measurement outside zero percent to 100 percent relative humidity.

If the FDD method is checking Heat eXchanger (HX) or refrigerant system faults, then step 504 will determine whether or not a temperature sensor is failed or faulted based on measuring at least one signal selected from the group consisting of: a floating signal, a grounded signal and a temperature measurement outside of a tolerance range selected from the group consisting of: a Heat eXchanger Temperature (HXT) sensor for heating less than 90° F. and greater than 460° F., a HXT sensor for cooling less than 20° F. and greater than 150° F., a Refrigerant Temperature (RT) for cooling less than 20° F. and greater than 150° F., or a Refrigerant Pressure (RP) sensor for cooling less than 25 pounds per square inch gauge (psig) and greater than 550 psig.

In step 506, the economizer measures the Outdoor Air Temperature (OAT) and Relative Humidity (RH) compares these values to the economizer setpoint temperature or RH setting to determine if the OAT is sufficiently cool or RH is sufficiently low for economizer-only cooling to attempt to satisfy the thermostat call for cooling. If the OAT is too warm or too humid, then the method proceeds to step 508 to enable AC compressor and set dampers to minimum position or modulate based on Demand Control Ventilation (DCV) based on carbon dioxide thresholds (typically ~1000 ppm per ASHRAE 62-1989). Note: if the OAT or RH are greater than the economizer setpoints at step 502 when the thermostat call for cooling is initiated, then steps 504 through 508 where the AC compressor is enabled are done simultaneously. Also note, that air temperature sensor FDD step 504 is performed continuously. If the OAT is cool enough to allow economizer cooling, then the method proceeds to step 518 to fully open or modulate the damper position to begin economizing with typically fully open dampers.

At step 508 AC compressor cooling is enabled and the economizer positions the dampers to the minimum position which allows minimum outdoor air into the space to satisfy minimum Indoor Air Quality (IAQ) requirements, and the method proceeds to step 510. At step 510, the method uses the MEMS device to determine if the actuator positioned the dampers to the correct minimum position. This will be indicated by the MEMS device providing an angular reading that the dampers have been positioned to the minimum position per the OAF Optimization method shown in FIG. 7. The magnetometer MEMS device will process and convert a magnetic field measurement into a magnetometer damper position measurement in the same units as a damper position actuator voltage command, and determine a difference between the magnetometer damper position measurement and the damper position actuator voltage command. If the difference is greater than the damper actuator voltage tolerance, then the method will generate a FDD alarm signal. If the dampers are at the minimum position, the method proceeds to step 512 and continues to enable the AC com pressor. If the MEMS device in step 510 indicates an incorrect damper position, then the method proceeds to step 528. Step 528 determines if the dampers are still in the closed position. If so, then the method proceeds to step 534 and the economizer signals an "Fault: Dampers Not Modulating." If in step 528, the MEMS device indicates that the dampers are not in a position that is not closed, then the method proceeds to step 530.

Step 530 determines if the MEMS device is indicating that the dampers are 100% open, and if so, proceeds to step 532 and indicates an "Fault: Economizing when Should Not." In step 530, if the dampers are not 100% open the method proceeds to step 536. In step 536, if the dampers did not move, then the method proceeds to step 534 to signal an "Fault: Dampers Not Modulating." If in step 536, the dampers did move, then the method proceeds to step 540. In step 540, if the dampers are open to the minimum position, then the method proceeds to step 548 and goes to the FDD evaluation method FIG. 8. In step 540, if the dampers are open to a position that is not the minimum position, then method proceeds to step 542 to determine if the damper position is greater then the minimum position, and if so, proceeds to step 544 and signals an "Fault: Excessive Outdoor Air" entering the conditioned space and proceeds to step 550 and goes to the OAF Optimization method FIG. 7 to correct this fault. If the dampers are less than the minimum position, step 540 proceeds to step 546 to signal an "Fault: Inadequate Outdoor Air" and proceeds to step 550 and goes to the OAF Optimization method FIG. 7 to correct this fault.

If the method determines that the MEMS did show the correct position, then the method proceeds to step 512 where the AC compressor is enabled or continues to be enabled, and the method proceeds to step 514 where an Outdoor Air Temperature (OAT) temperature probe or an Outdoor Air Relative Humidity (OA RH) sensor determines whether or not the OAT or OA RH are too high. If the method determines that No (N) the OAT and OA RH are not too high (i.e., OAT and OA RH are below economizer high limit setpoints per the present invention), then the method loops back to step 502 to continue cooling until the thermostat call for cooling is satisfied. If step 514 determines that the Yes (Y) the OAT and OA RH are too high (i.e., above OAT and an OA RH economizer high limit setpoints per the present invention), then the method proceeds to step 511 to close the dam pers and proceeds to step 514.

If step 506 determines that the Outdoor Air Temperature (OAT) is below the economizer setpoint to allow economizer-only cooling with outdoor air (and AC compressor off), then the method proceeds to step 518 where the economizer fully opens the dampers or modulates the damper position between fully open and minimum position to achieve the desired SAT. While the economizer is modulating the damper position, step 520 monitors the MEMS device to determine if the dampers are open to the correct position based on the economizer command. If the economizer commands a 75% open position, then the MEMS device will monitor the position to ensure the dampers are open to a 75% open position. If step 520 indicates that the dampers are modulating properly, then the method proceeds to step 522 to com pare the OAT and OA RH to the economizer setpoints (i.e., OAT and OA RH high limits per the present invention) and check whether or not the thermostat economizer-only timer has been reached for economizer-only cooling (typically 5 to 10 minutes). If the OAT or OA RH are below the economizer setpoints and the thermostat economizer-only timer has not been exceeded, then the method loops back to step 502 to continue until the thermostat call for cooling is satisfied. If in step 522, the OAT or OA RH are higher than the economizer setpoints or the thermostat economizer-only timer has been exceeded, then the method proceeds to step 512 to enable or continue to enable AC com pressor cooling and proceeds to step 514. At step 514 if OAT or OA RH are below the economizer setpoints ( )hen the method proceeds to step 502 to continue until the thermostat call for cooling is satisfied. If the OAT or OA RH are higher than the economizer setpoints, then the method proceeds to step 511 and closes the economizer dampers and proceeds to step 515. At step 515, the m ethod checks if the SAT is too warm, and if not, then the method proceeds to step 502 to continue until the thermostat call for cooling is satisfied. At step 515, if the SAT is too warm, then the method proceeds to step 548 to go to the FDD Evaluation Method FIG. 8 to determine if another cooling fault causing the SAT to be too warm (i.e., low cooling capacity due to low refrigerant charge, evaporator or condenser heat transfer faults, etc).

Prior to steps 522 through 548, at step 520 the MEMS device determines that the dampers are not following the economizer position command from step 518, then the method proceeds to step 524 and signals an "Fault: Not economizing When Should." If step 520 determines that the dampers are stuck in one position and not modulating, then the method proceeds to step 534 and the economizer signals an "Fault: Dampers Not Modulating."

Figure 24:
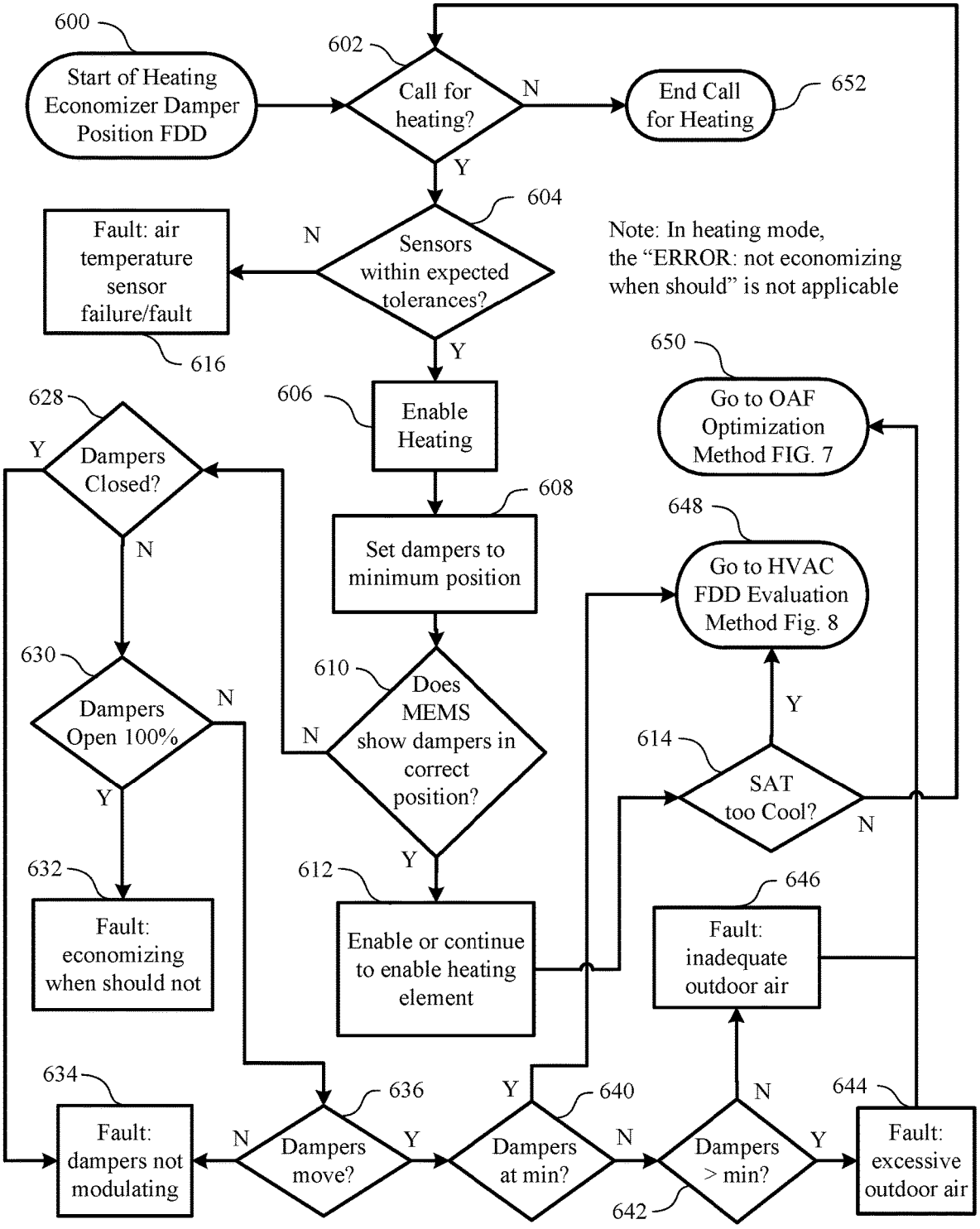
FIG. 24 shows a flow chart for detecting and diagnosing economizer faults during a call for heating using a MEMS device to measure the physical position of the dampers as well as air temperature sensors according to the present invention.

FIG. 24 is similar to FIG. 23 but shows the heating economizer damper position FDD method using a MEMS device such as a magnetometer, an accelerometer, an IMU or a rotatiometer to measure the physical position of the dampers and determine if there is a fault with the economizer damper positioning mechanism. The fault detection process involves positioning the dampers to a fully closed position and the MEMS sensor device is sampled to store this angular position. The dampers are then moved to a fully open position and the MEMS sensor is sam pled again and the angular position is stored. As the dampers modulate between the fully closed position and fully open position, the MEMS device returns an angular value and the physical position of the dampers can be calculated. Step 600 is the start of the Heating Economizer Damper Position FDD method. In step 602, the economizer monitors the signals from the thermostat to determine if there is a call for heating. If there is no call for heating. the FDD method proceeds to Step 652 End Call for Heating. If there is call for heating the method proceeds to step 604. In step 604, the econom izer monitors the temperature sensors and the MEMS device to determine if values returned from these elements are within expected tolerances. For instance, if one of the temperature sensors is an open circuit or a short circuit, the economizer will flag this fault and proceed to step 616 and indicate an "Fault: Air Temperature Sensor Failure/Fault" for sensors not working.

In step 604, the method determines whether or not an air temperature sensor is failed or faulted based on measuring at least one signal selected from the group consisting of: a floating signal, a grounded signal and a temperature measurement outside of a tolerance range selected from the group consisting of: OAT less than −50° F. or greater than +140° F., RAT less than 50° F. or greater than 120° F., MAT less than −50° F. or greater than +140° F., SAT for cooling less than 33° F. or greater than 120° F. and SAT for heating less than 65° F. or greater than 140° F. At step 604, the method can also determine whether or not a relative humidity sensor is failed or faulted based on measuring at least one signal selected from the group consisting of: a floating signal, a grounded signal and a relative humidity measurement outside zero percent to 100 percent relative humidity.

If the FDD method is checking heat exchanger (HX) or refrigerant system faults, then step 604 will determine whether or not a temperature sensor is failed or faulted based on measuring at least one signal selected from the group consisting of: a floating signal, a grounded signal and a temperature measurement outside of a tolerance range selected from the group consisting of: a Heat eXchanger Temperature (HXT) sensor for heating less than 90 F and greater than 460 F, a heat pump Refrigerant Temperature (RT) less than 20 F and greater than 150 F, or a heat pump Refrigerant Pressure (RP) sensor less than 25 pounds per square inch gauge (psig) and greater than 550 psig.

If all sensors are within expected tolerances, then the method proceeds to step 606. In step 606, the heating system is enabled and the method proceeds to step 608. Note: step 606 to enable heating is done simultaneously with sensor diagnostics. Also note that air temperature sensor FDD at step 604 is performed continuously. In step 608, the economizer positions the dampers to the set minimum position to provide a minimum amount of outdoor air into the space to satisfy IAQ requirements or Demand Control Ventilation (DCV) based on carbon dioxide thresholds (typically ~1000 ppm per ASHRAE 62-1989). The method then proceeds to step 610.

Step 610 first uses the MEMS to determine if the actuator responded by positioning the dampers to the minimum position. This will be indicated by the MEMS device providing an angular reading that the dampers have been positioned to the minimum position. If the dampers are at the minimum position, the method proceeds to step 612 and the heating element continues to be enabled. If the MEMS device indicates an incorrect damper angle position, then the method proceeds to step 628.

Step 628 determines if the dampers are still in the closed position. If so, the method proceeds to step 634 and the economizer signals a fault that the dampers are not modulating. If in step 628, the MEMS device indicates that the dampers are in a position that is not closed, the method proceeds to step 630. Step 630 determines if the MEMS device is indicating that the dampers are 100% open and if so, proceeds to step 632 and signals an "Fault: Economizing When Should Not."

In step 630, if the dampers are not 100% open the method proceeds to step 636. In step 636, the economizer determines if the dampers have moved, and if not, proceeds to step 634. In step 634, the economizer signals an "Fault: Dampers Not Modulating." If step 636 determines that the dampers have moved then step 640 determines if the dampers are at the minimum position. In step 640, if the dampers are open to the minimum position, then the method proceeds to step 648 and goes to the FDD evaluation method FIG. 8.

In step 640, if the dampers are open to a position that is not the minimum position, then method proceeds to step 642 to determine if the damper position is greater then the minimum position, and if so, proceeds to step 644 and signals an "Fault: Excessive Outdoor Air" entering the conditioned space and proceeds to step 650 and goes to the OAF Optimization method FIG. 7 to correct this fault. If the dampers are less than the minimum position, step 640 proceeds to step 646 to signal an "Fault: Inadequate Outdoor Air" and proceeds to step 650 and goes to the OAF Optimization method FIG. 7 to correct this fault.

After step 612 to enable or continue enabling heating element, the method then proceeds to step 614 where the SAT is monitored. If the heating element is able to meet the SAT temperature requirements, then the method loops back to step 602 and continues until the thermostat call for heating is satisfied. If step 614 determines that the SAT is too cold, then the method proceeds to step 644 and proceeds to the HVAC FDD Evaluation Method FIG. 8 to check the temperature rise across the heating element and determine whether or not to report a low heating capacity fault.

In some embodiments, the method includes providing FDD alarms regarding the following faults: excess outdoor air, damper actuator failure, low airflow, low cooling capacity, low refrigerant charge, noncondensables, refrigerant restrictions, failed reversing valve, low heating capacity or other faults. In some embodiments the present invention includes methods to communicate FDD alarms using wired or wireless communication to display fault codes or alarms on the present invention apparatus through a built-in display or external display through wired or wireless communication signals to a building energy management system, standard thermostat, WIFI-enabled thermostat, internet-connected computer, internet telephony system, or smart phone indicating maintenance requirements to check and correct damper position, evaporator airflow and/or refrigerant charge of the air conditioning system.

While the invention herein disclosed has been described by means of specific embodiments and applications thereof, numerous modifications and variations could be made thereto by those skilled in the art without departing from the scope of the invention set forth in the claims.

We claim:

1. Apparatus to provide Fault Detection Diagnostics (FDD) for a Heating, Ventilating, Air Conditioning (HVAC) system with an economizer comprising:

a microprocessor;

a permanent magnet attached to a movable damper, wherein the permanent magnet is configured to create a magnetic field;

a magnetometer sensor attached to a stationary frame, wherein the magnetometer sensor is configured to measure the magnitude and direction of the magnetic field of the permanent magnet, and generate a magnetic field measurement representing the magnetic field of the permanent magnet;

an electric power supply input;

at least one input selected from the group consisting of: a wired electrical input, and a wireless electrical input, wherein the at least one input is configured to receive at least one HVAC parameter selected from the group consisting of:

the magnetic field measurement representing the magnetic field of the permanent magnet, a damper position actuator voltage command, a damper position actuator voltage tolerance, an intermediate Outdoor Air Fraction (OAF) damper position command, an intermediate OAF damper position tolerance, at least one signal from a thermostat to indicate a call for cooling or a call for heating, an air temperature measurement, a Relative Humidity (RH) measurement, a Carbon Dioxide (CO2) measurement; and at least one electrical output selected from the group consisting of: a wired electrical output, and a wireless electrical output, wherein the at least one electrical output is configured to provide at least one signal selected from the group consisting of:

a signal to control a movable damper position, a signal providing the at least one HVAC parameter, and a signal to provide the at least one FDD alarm signal; and wherein the microprocessor is configured to perform at least one action selected from the group consisting of:

process and convert the magnetic field measurement into a magnetometer damper position measurement in the same units as the damper position actuator voltage command, and determine a difference between the magnetometer damper position measurement and the damper position actuator voltage command, and if the difference is greater than the damper actuator voltage tolerance, then generate the at least one FDD alarm signal, and calculate a computed intermediate OAF damper position based on the at least one HVAC parameter, and if the difference between the computed intermediate OAF damper position and the intermediate OAF damper position command is greater than the intermediate OAF damper position tolerance, then generate the at least one FDD alarm signal or provide a signal to control the movable damper position to correct the intermediate OAF damper position command.

2. The apparatus of claim 1, wherein the microprocessor is configured to receive the at least one input from the magnetometer sensor to to measure the magnitude and direction of the magnetic field of the permanent magnet and provide the magnetometer damper position measurement within a 3-dimensional coordinate system selected from the group consisting of:

a fully closed position where the magnetometer sensor is sampled by the microprocessor to store a fully closed position value, a fully open position where the magnetometer sensor is sampled by the microprocessor to store a fully open position value, and an intermediate OAF damper position between the fully closed position and fully open position where the magnetometer sensor is sampled by the microprocessor to store an intermediate OAF damper position value.

3. The apparatus of claim 1, wherein:

the microprocessor is configured to detect whether or not the sensor electrical signal input or sensor measurement indicates at least one failed or faulted signal or sensor measurement selected from the group consisting of:

a floating signal, a grounded signal, and a sensor measurement outside of a tolerance; and if the sensor electrical signal input or sensor measurement are failed or faulted, then the microprocessor is configured to provide the at least one FDD alarm.

4. The apparatus of claim 1, wherein:

the microprocessor is configured to detect whether or not the electrical signal input from the magnetometer sensor indicates the magnetometer damper position measurement is outside of at least one required tolerance causing a fault selected from the group consisting of:

the call for cooling or the call for heating and the movable damper is stuck in the fully closed position or stuck open in a position less than the fully open position causing a dampers not modulating fault, the call for cooling and an outdoor air temperature does not allow economizer cooling and the movable damper is open to a position greater than the intermediate OAF damper position causing an excessive outdoor air fault, the call for heating and the movable damper is open to a position greater than the intermediate OAF damper position causing the excessive outdoor air fault, the call for cooling and the outdoor air temperature does not allow economizer cooling and the movable damper is fully open causing an economizing when should not fault, the call for heating and the movable damper is fully open causing the economizing when should not fault, the call for cooling and the outdoor air temperature allows economizer cooling and the movable damper is not fully open causing a not economizing when should fault, and the call for cooling and the outdoor air temperature allows economizer cooling and the movable damper is not modulating to the correct position causing a not modulating fault; and if the magnetometer damper position measurement is outside of the at least one required tolerance, then the microprocessor is configured to provide the at least one FDD alarm signal.

5. The apparatus of claim 1, wherein the microprocessor is configured to detect at least one fault selected from the group consisting of:

dampers not modulating when the dampers do not move to a position commanded by the economizer, excessive outdoor air when the dampers are open beyond a position commanded by the economizer during at least one operating period selected from the group consisting of: the HVAC system is off, a fan only operation, the call for cooling, and the call for heating, economizing when should not when the dampers are open beyond the intermediate OAF damper position command when the outdoor air temperature or relative humidity are above a threshold setting, not economizing when should when the dampers are open less than a fully open position when an outdoor air temperature or an outdoor relative humidity are below a threshold setting, and inadequate outdoor air when the dampers are open less than the intermediate OAF damper position command during at least one operating period selected from the group consisting of: the HVAC system is off, the fan only operation, the call for cooling, and the call for heating.

6. The apparatus of claim 1, wherein the magnetometer sensor is a magnetometer Micro-Electro-Mechanical Systems (MEMS) device attached to the stationary frame and a fixed permanent magnet attached to the movable damper wherein the damper travels moves from one position to another position and the magnetometer sensor detects the magnitude and direction of a 3-dimensional magnetic field from the permanent magnet and from this information the magnetometer sensor provides the magnetometer damper position measurement with respect to at least one reference or rotational position within a 3-dimensional coordinate system.

7. The apparatus of claim 1, wherein the intermediate OAF damper position command is a number greater than or equal to zero and less than or equal to one and the damper position actuator voltage command is a voltage ranging from a minimum voltage to a maximum voltage, and the damper position actuator voltage command is converted to the damper position command to compare to the magnetometer damper position measurement by calculating a difference between the damper position actuator voltage command minus the minimum voltage divided by the difference between the maximum voltage minus the minimum voltage.

8. The apparatus of claim 1, wherein the microprocessor is configured to calculate a computed intermediate OAF damper position based on a ratio of a first difference between a return air temperature measurement and a mixed air temperature measurement divided by a second difference between the return air temperature measurement and an outdoor air temperature measurement.

9. The apparatus of claim 6, wherein the microprocessor is configured to calculate the computed intermediate OAF if an absolute value of a third difference between the return air temperature measurement and the outdoor air temperature measurement is greater than 10 degrees Fahrenheit.

10. The apparatus of claim 1, wherein the microprocessor is configured to provide a signal to correct the damper position actuator voltage command by performing at least one action selected from the group consisting of:

measure and store the intermediate OAF damper position actuator voltage and a corresponding computed intermediate OAF measurement, measure and store a fully open OAF damper position actuator voltage and a corresponding computed fully open OAF measurement, measure and store a closed OAF dam per position actuator voltage and a corresponding computed closed OAF measurement, perform a line or curve fit to at least three ordered pairs of the damper position actuator voltage and the corresponding computed OAF measurements to obtain a mathematical formula for the damper position actuator voltage command as a function of the intermediate OAF damper position command, and compute a signal to correct the damper position actuator voltage command based on the mathematical formula for the damper position actuator voltage command as a function of the intermediate OAF damper position command.

11. The apparatus of claim 1, wherein the microprocessor is configured to provide a signal to correct the damper position actuator voltage command by calculating the coefficients of a predictive quadratic regression equation using a least squares method involving partial derivatives to minimize residuals for each ordered pair of data by expressing the least squares regression equation in matrix form, comprising the steps of:

constructing at least a 3×3 matrix X, containing exactly one "n" element and summations of "i" to "n" x-value exponential elements and summations of "i" to "n" x-value elements;

inverting the X matrix to obtain $X^{-1}$;

constructing a matrix Y, containing minimized residual elements including summations of "i" to "n" x-values to the power n-1 times y-values, summations of "i" to "n" x-values times y-values, and summations of "i" to "n" y-values; and multiplying $X^{-1}$ times Y to obtain regression equation coefficients a, b, and c, wherein the signal to correct the damper position actuator voltage command is calculated using a quadratic formula involving regression coefficients a, b, and c and wherein the intermediate OAF damper position command is subtracted from coefficient c.

12. Apparatus to provide Fault Detection Diagnostics (FDD) for a Heating, Ventilating, Air Conditioning (HVAC) system comprising:

an electric power supply input, a microprocessor;

a permanent magnet attached to a movable damper, wherein the permanent magnet is configured to create a magnetic field;

a magnetometer sensor attached to a stationary frame configured to measure the magnitude and direction of the magnetic field of the permanent magnet when the movable damper travels from one position to another position wherein the magnetometer sensor is configured to generate a magnetic field measurement representing the magnetic field of the permanent magnet;

at least one input selected from the group consisting of: a wired electrical input, and a wireless electrical input, wherein the at least one input is configured to receive at least one HVAC parameter selected from the group consisting of:

the magnetic sensor measurement representing the magnetic field of the permanent magnet, a damper position actuator voltage command to control a damper position and control an airflow wherein the damper position varies from a fully closed position to a fully open position with at least one intermediate position between the fully closed position and the fully open position, a damper position actuator voltage tolerance, an air temperature measurement or an air temperature measurement tolerance, and at least one signal to indicate a thermostat call for cooling or a thermostat call for heating; and at least one electrical output selected from the group consisting of: a wired electrical output, and a wireless electrical output, wherein the at least one electrical output is configured to provide at least one signal selected from the group consisting of:

a signal to control a movable damper position, a signal providing the at least one HVAC parameter, and at least one FDD alarm signal; and wherein the microprocessor is configured to process and convert the magnetic field measurement into a magnetometer damper position measurement in the same units as the damper position actuator voltage command, and determine a difference between the magnetometer damper position measurement and the damper position actuator voltage command, and if the difference is greater than the damper position actuator voltage tolerance, then generate the at least one FDD alarm signal.

13. The apparatus of claim 12, wherein the damper position actuator voltage command ranges from a minimum voltage to a maximum voltage, and the damper position actuator voltage command is converted to the damper position command to compare to the magnetometer damper position measurement by calculating a difference between the damper position actuator voltage command minus the minimum voltage divided by the difference between the maximum voltage minus the minimum voltage.

14. The apparatus of claim 12, wherein the microprocessor uses the magnetometer sensor to measure the magnitude and direction of the magnetic field of the permanent magnet and provide the magnetometer damper position measurement within a 3-dimensional coordinate system selected from the group consisting of:

the fully closed position where the magnetometer sensor is sampled by the microprocessor to store a closed position value, the fully open position where the magnetometer sensor is sampled by the microprocessor to store a fully open position value, and the at least one intermediate damper position between the fully closed position and fully open position where the magnetometer sensor is sampled by the microprocessor to store the at least one intermediate damper position value.

15. The apparatus of claim 12, wherein the microprocessor is configured to determine a damper position error equal to the difference between the magnetometer damper position measurement and the damper position actuator voltage command, wherein the microprocessor is further configured to detect:

whether or not the damper position error is outside of at least one required tolerance causing a fault selected from the group consisting of:

the call for cooling or the call for heating and the moveable damper is stuck in the closed position or stuck in an open position less than fully open causing a damper not modulating fault, the call for cooling and an outdoor air temperature does not allow economizer cooling and the movable damper is open to a position greater than the at least one intermediate damper position causing an excessive outdoor airflow fault or an excessive airflow fault, the call for heating and the moveable damper is open to a position greater than the at least one intermediate damper position causing the excessive outdoor airflow fault or the excessive airflow fault, the call for cooling and the outdoor air temperature does not allow economizer cooling and the moveable damper is fully open causing an economizing when should not fault, the call for heating and the moveable damper is fully open causing the economizing when should not fault, the call for cooling and the outdoor air temperature allows economizer cooling and the moveable damper is not fully open causing a not economizing when should fault, and the call for cooling and the outdoor air temperature allows economizer cooling and the moveable damper is not modulating to the correct position causing a not modulating fault; and if the damper position error is outside of the required tolerance, then the microprocessor is configured to provide the at least one FDD alarm signal.

16. The apparatus of claim 12, wherein the microprocessor is configured to detect at least one fault selected from the group consisting of:

the moveable damper not modulating when the moveable damper does not move to a position commanded by the economizer, excessive outdoor airflow when the moveable damper is open beyond a position commanded by the economizer during at least one operating period selected from the group consisting of: the HVAC system is off, a fan only operation, the call for cooling, the call for heating, economizer operation when the moveable damper is open beyond the at least one intermediate damper position when an outdoor air temperature is above a threshold setting, not economizing when the moveable dampers are open less than the fully open position when the outdoor air temperature is below a threshold setting, and inadequate outdoor air when the moveable dampers are open less than the at least one intermediate damper position command during at least one operating period selected from the group consisting of: the HVAC system is off, the fan only operation, the call for cooling, the call for heating; and if the at least one fault is detected, then the microprocessor is configured to provide the at least one FDD alarm signal.

17. The apparatus of claim 12, wherein the magnetometer sensor is a magnetometer Micro-Electro-Mechanical Systems (MEMS) device attached to the stationary frame and a fixed permanent magnet attached to the movable damper wherein the moveable damper travels from one position to a different position and the magnetometer sensor detects the magnitude and direction of the 3-dimensional magnetic field from the permanent magnet and from this information the magnetometer sensor provides the damper position with respect to at least one reference or rotational position within a 3-dimensional coordinate system.

18. The apparatus of claim 12, wherein if the magnetometer sensor is failed or the measurement is faulted or the difference between the magnetometer damper position measurement and the damper position actuator voltage command is outside of a damper position actuator tolerance, then the microprocessor is configured to provide the at least one FDD alarm signal for the magnetometer sensor or the damper position.

* * * * *